US012780585B2

(12) United States Patent
Sato

(10) Patent No.: US 12,780,585 B2
(45) Date of Patent: Nov. 3, 2026

(54) SHEET PROCESSING APPARATUS, IMAGE FORMING SYSTEM, AND CONTROL METHOD

(71) Applicant: Konica Minolta, Inc., Tokyo (JP)

(72) Inventor: Ryuji Sato, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 19/187,110

(22) Filed: Apr. 23, 2025

(65) Prior Publication Data

US 2025/0328103 A1 Oct. 23, 2025

(30) Foreign Application Priority Data

Apr. 23, 2024 (JP) ..... 2024-069690

(51) Int. Cl.
*B65H 31/36* (2006.01)
*B65H 31/02* (2006.01)

(52) U.S. Cl.
CPC ..... *B65H 31/36* (2013.01); *B65H 31/02* (2013.01); *B65H 2404/1114* (2013.01); *B65H 2801/27* (2013.01)

(58) Field of Classification Search
CPC .. B65H 31/36; B65H 2404/1114; B65H 31/02
See application file for complete search history.

(56) References Cited

U.S. PATENT DOCUMENTS

| | | | | |
|---|---|---|---|---|
| 8,328,192 | B2 * | 12/2012 | Yamazaki | B65H 7/02 271/262 |
| 10,005,637 | B1 * | 6/2018 | Wilsher | B65H 43/02 |
| 10,479,636 | B2 * | 11/2019 | Nakano | B65H 29/20 |
| 12,434,936 | B2 * | 10/2025 | Noso | B65H 31/02 |
| 2018/0251331 | A1 | 9/2018 | Nakano | |
| 2024/0017953 | A1 | 1/2024 | Sato | |

FOREIGN PATENT DOCUMENTS

| | | | |
|---|---|---|---|
| JP | 4838687 | B2 | 10/2011 |
| JP | 2018144911 | A | 9/2018 |
| JP | 2024010926 | A | 1/2024 |

* cited by examiner

*Primary Examiner* — Jeremy R Severson
(74) *Attorney, Agent, or Firm* — CANTOR COLBURN LLP

(57) ABSTRACT

A sheet processing apparatus includes: a tray on which conveyed sheets are stacked one by one; a restricting member provided at one end of the tray; a paddle member provided so as to be able to ascend and descend on the tray and configured to abut and align one end of the sheet against the restricting member by rotating in contact with the conveyed sheet; and a controller that determines a height position of the paddle member on the tray based on the number of sheets stacked on the tray and sheet information of the sheet to be conveyed, and controls the height position of the paddle member.

16 Claims, 19 Drawing Sheets

FIB. 19C

SHEET PROCESSING APPARATUS, IMAGE FORMING SYSTEM, AND CONTROL METHOD

CROSS REFERENCE TO RELATED APPLICATIONS

The present invention claims priority under 35 U.S.C. § 119 to Japanese Patent Application No. 2024-069690 filed on Apr. 23, 2024, the entire content of which is incorporated herein by reference.

BACKGROUND OF THE INVENTION

Technical Field

The present invention relates to a sheet processing apparatus, an image forming system, and a control method, and particularly to a technique for aligning sheets on a tray.

Description of Related Art

Conventionally, in order to align sheets discharged from an image forming apparatus, a sheet processing apparatus including a paddle member has been proposed (for example, Japanese Unexamined Patent Publication No. 2018-144911). Each time one sheet is ejected from the image forming apparatus, the sheet processing apparatus rotates the paddle member to align a rear end of the sheet at a predetermined position on the tray. In the sheet processing apparatus, when the sheets are aligned, the paddle member is lowered onto the tray and rotated. In the conventional sheet processing apparatus, when the number of sheets stacked on the tray reaches a predetermined number, the amount of movement of the paddle member when the paddle member is lowered onto the tray is controlled to be reduced.

Incidentally, in recent years, a sheet processing apparatus provided with a puddle member is sometimes mounted on a body portion of an apparatus main body of an image forming apparatus (for example, Japanese Unexamined Patent Publication No. 2024-10926). When the sheet processing apparatus is mounted on the body portion of the apparatus main body, it is essential to miniaturize the sheet processing apparatus. Therefore, it is inevitable to reduce the diameter of the paddle member for aligning the sheet. When the diameter of the paddle member is reduced, it is difficult to apply an appropriate conveying force to the sheet in order to align the sheet. For example, when the root portion of the paddle member comes into contact with the sheet, the conveying force increases, and thus the sheet may be buckled at the time of sheet alignment. On the other hand, a sufficient conveying force cannot be obtained simply by the tip end portion of the paddle member hitting the sheet, and alignment failure may occur. Therefore, there is a problem that the sheets cannot be appropriately aligned only by controlling the movement amount of the paddle member for each predetermined number of sheets as in the above-described conventional technique.

SUMMARY OF THE INVENTION

The present invention has been devised in order to solve the above-described problems. An object of the present invention is to provide a sheet processing apparatus, an image forming system, and a control method capable of appropriately aligning a sheet.

In order to achieve the above object, first, the present invention is directed to a sheet processing apparatus.

In accordance with one aspect of the invention, the sheet processing apparatus includes: a tray on which conveyed sheets are stacked one by one; a restricting member provided at one end of the tray; a paddle member provided so as to be able to ascend and descend on the tray and configured to abut and align one end of the sheet against the restricting member by rotating in contact with the conveyed sheet; and a controller that determines a height position of the paddle member on the tray based on the number of sheets stacked on the tray and sheet information of the sheet to be conveyed, and controls the height position of the paddle member.

Second, the present invention is directed to an image forming system.

In accordance with one aspect of the present invention, an image forming system includes: an image forming apparatus that conveys a sheet one by one and forms an image on the sheet being conveyed; and a sheet processing apparatus. The sheet processing apparatus includes: a tray on which conveyed sheets are stacked one by one; a restricting member provided at one end of the tray; a paddle member provided so as to be able to ascend and descend on the tray and configured to abut and align one end of the sheet against the restricting member by rotating in contact with the conveyed sheet; and a controller that determines a height position of the paddle member on the tray based on the number of sheets stacked on the tray and sheet information of the sheet to be conveyed, and controls the height position of the paddle member. The sheet processing apparatus receives the sheet on which an image is formed in the image forming apparatus and aligns one end of the sheet on the tray by making the one end abut on the restricting member.

Third, the present invention is directed to a control method for controlling a sheet processing apparatus. The sheet processing apparatus includes: a tray on which sheets to be conveyed are stacked one by one; a restricting member provided at one end of the tray; and a paddle member that is provided so as to be able to ascend and descend on the tray and that abuts one end of the sheet against the restricting member to align the sheet by rotating in contact with the sheet to be conveyed.

In accordance with one aspect of the present invention, the control method includes: determining the height position of the paddle member on the tray based on the number of sheets stacked on the tray and sheet information of the sheet to be conveyed and controlling the height position of the paddle member.

BRIEF DESCRIPTION OF THE DRAWINGS

The advantages and features provided by one or more embodiments of the invention will become more fully understood from the detailed description given herein below and the appended drawings which are given by way of illustration only, and thus are not intended as a definition of the limits of the present invention.

FIG. 19A, FIG. 19B, and FIG. 19C are diagrams illustrating a conveying power to be applied to the sheet by two rotations of the paddle member.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, preferred embodiments of the present invention will be described in detail with reference to the drawings. Note that elements common to the embodiments described below are denoted by the same reference signs, and redundant description thereof is omitted.

Figure 1:
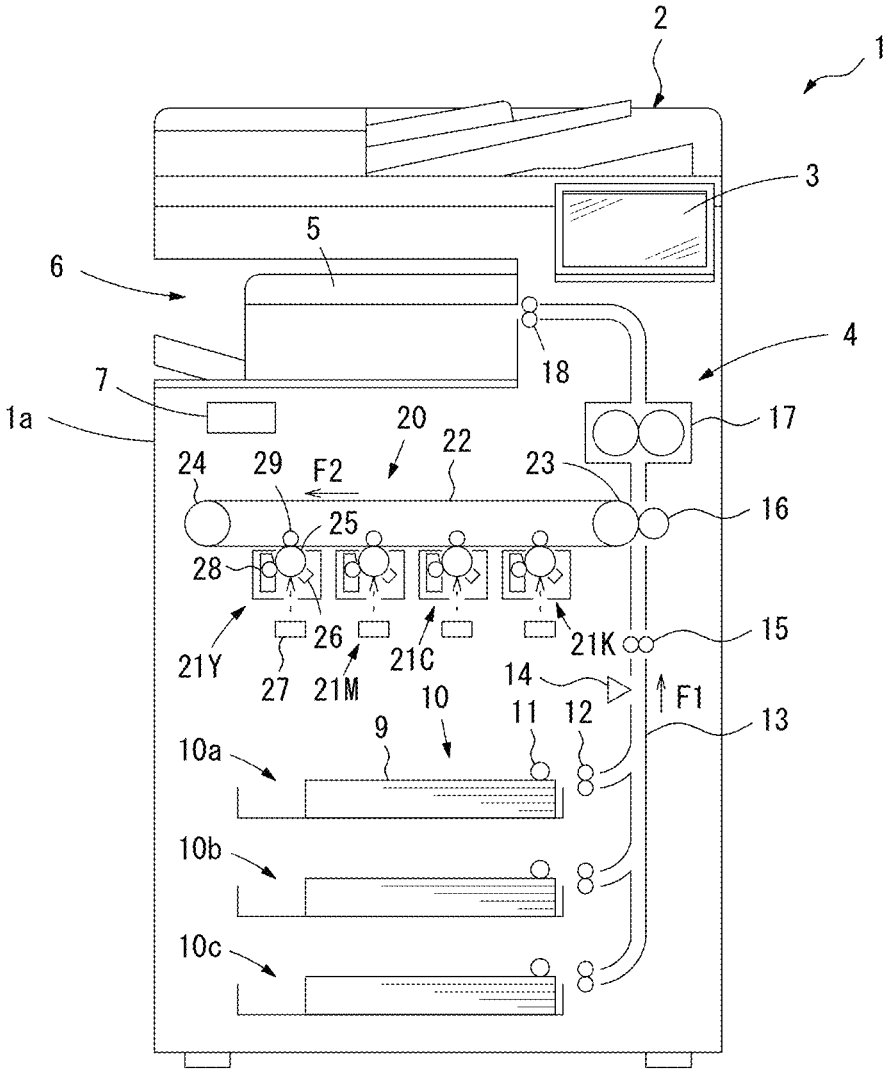
FIG. 1 is a conceptual diagram illustrating an overall configuration of an image forming system.

FIG. 1 is a conceptual diagram illustrating an overall configuration of an image forming system according to an embodiment of the present invention. The image forming system includes an image forming apparatus 1 and a sheet processing apparatus 5. The image forming apparatus 1 is configured as, for example, a multifunction peripheral (MPF), and is provided with a plurality of functions such as scanning, printing, and copying functions in an apparatus body 1*a*. The sheet processing apparatus 5 is mounted in a body space 6 provided at center position in the vertical direction of the apparatus body 1*a* of the image forming apparatus 1, and performs post-processing such as stapling on one or more sheets 9 on which an image is formed and which is discharged from the image forming apparatus 1.

The image forming apparatus 1 includes a scanner unit 2 at an upper part of the apparatus body 1*a*. Further, the image forming apparatus 1 includes an operation panel 3 operable by a user on the front side of the scanner unit 2. The operation panel 3 includes a display unit that displays various setting screens and an operation unit that receives an operation by a user.

Further, the image forming apparatus 1 includes a printer unit 4 in a lower part of the apparatus body 1*a*. The printer unit 4 forms an image on a sheet 9 and discharges the sheet 9 to the body space 6 between the printer unit 4 and the scanner unit 2. FIG. 1 shows an internal structure of the printer unit 4. As shown in FIG. 1, the printer unit 4 includes a sheet feeding and conveying unit 10 and an image forming unit 20. The printer unit 4 includes a controller 7 that integrally controls the operation of the image forming apparatus 1.

A sheet conveying unit 10 feeds the sheet 9 from any one of the plurality of sheet feed trays 10*a*, 10*b*, and 10*c*, and conveys the sheet 9 along a conveyance path 13 formed inside a printer unit 4. The plurality of sheet feed trays 10*a*, 10*b*, and 10*c* may accommodate sheets 9 of different types or sheets 9 of the same type. Each of the sheet feed trays 10*a*, 10*b*, and 10*c* is provided with a pickup roller 11 and a sheet feed roller 12. The sheet conveying unit 10 drives the pickup roller 11 and the sheet feed roller 12 provided in one sheet feed tray specified by a user, to feed the sheet 9 toward a conveyance path 13. The sheet conveying unit 10 conveys the sheet 9 sent to the conveyance path 13 along the direction of the arrow F1.

In the conveyance path 13, a medium detecting unit 14, a timing roller 15, a secondary transfer roller 16, a fixing unit 17, and a discharge roller 18 are arranged.

The medium detecting unit 14 is a sensor that detects the type of the sheet 9 when the sheet 9 passes through a predetermined position of the conveyance path 13. For example, the medium detecting unit 14 detects a thickness, a basis weight, and the like of the sheet 9 to be conveyed. A detection result by the medium detecting unit 14 is output to the controller 7. The controller 7 acquires the detection result by the medium detecting unit 14 as sheet information. Then, the controller 7 controls a fixing temperature or the like in a fixing unit 17 based on the sheet information. Further, the controller 7 sends the sheet information acquired from the medium detecting unit 14 to the sheet processing apparatus 5.

A timing roller 15 is composed of a pair of rollers. The timing roller 15 is a roller that adjusts the timing at which the sheet 9 is fed to the secondary transfer position by the secondary transfer roller 16. When a leading end of the sheet 9 fed from one of the sheet feed trays 10*a*, 10*b*, and 10*c* reaches a position of the timing roller 15, the sheet conveying unit 10 temporarily stops conveyance of the sheet 9. The sheet conveying unit 10 then drives the timing roller 15 in accordance with the timing at which the image primarily transferred onto the intermediate transfer belt 22 in the image forming unit 20 is conveyed to the secondary transfer position, to convey the sheet 9 toward the secondary transfer roller 16.

When the sheet 9 fed from the timing roller 15 passes through a secondary transfer position by the secondary transfer roller 16, an image is secondarily transferred onto the sheet 9. Then, the sheet 9 to which the image is secondarily transferred advances toward the fixing unit 17.

The image forming unit 20 includes image forming units 21Y, 21M, 21C, and 21K corresponding to the colors yellow (Y), magenta (M), cyan (C), and black (K), and an intermediate transfer belt 22.

The image forming unit 21Y is a unit that forms an image in a color corresponding to Y. The image forming unit 21Y includes an image carrier 25 formed with a photosensitive drum or the like, a charging device 26, an exposure device 27, and a developing device 28. The image carrier 25 has a photosensitive layer on the surface of a cylindrical body and rotates in a predetermined direction (clockwise direction). The charging device 26, the exposure device 27, and the developing device 28 are disposed around the image carrier 25. The charging device 26 charges the surface of the image carrier 25 to a predetermined charge. The exposure device 27 exposes the charged surface of the image carrier 25 on the basis of image data to form an electrostatic latent image on the surface of the image carrier 25. The developing device 28 supplies toner to the surface of the image carrier 25 to visualize the electrostatic latent image with the toner. Thus, an image (toner image) is formed on the surface of the image carrier 25 according to the corresponding image data. The other image forming units 21M, 21C, and 21K have the same configuration as the image forming unit 21Y and are different only in the color of the toner supplied to the image carrier 25. That is, the plurality of image forming units 21Y, 21M, 21C, and 21K having the same configuration are arranged at predetermined intervals.

A intermediate transfer belt 22 is an endless belt disposed above the image forming units 21Y, 21M, 21C, and 21K. The intermediate transfer belt 22 is stretched around a drive roller 23 provided at a position opposing the secondary transfer roller 16 and a driven roller 24 provided at a position separated from the drive roller 23 by a predetermined gap. As the drive roller 23 is rotationally driven in the counter-clockwise direction, the intermediate transfer belt 22 circulates in a direction indicated by an arrow F2. The intermediate transfer belt 22 contacts the secondary transfer roller 16 at the position of the drive roller 23.

Inside the intermediate transfer belt 22, primary transfer rollers 29 are provided at positions opposing the image forming units 21Y, 21M, 21C, and 21K, respectively. When a predetermined voltage is applied to the primary transfer roller 29 in a state where the intermediate transfer belt 22 is pressed against the image carrier 25 of each of the image forming units 21Y, 21M, 21C, and 21K, the primary transfer roller 29 causes an image (toner image) formed on the image carrier 25 to be primarily transferred onto the intermediate transfer belt 22. The image forming units 21Y, 21M, 21C, and 21K form a color image on the intermediate transfer belt 22 by primarily transferring Y, M, C, and K images onto the intermediate transfer belt 22 while sequentially superimposing the Y, M, C, and K images. Then, the image transferred onto the intermediate transfer belt 22 is secondarily transferred onto the sheet 9 at a position of the secondary transfer roller 16.

The fixing unit 17 fixes the image on the sheet 9 by performing a heating process and a pressing process on the sheet 9 on which the image is formed. For example, the fixing unit 17 includes a heating roller and a pressure roller and performs heating processing and pressure processing on the sheet 9 in a nip portion between the heating roller and the pressure roller. The surface temperature of the heating roller is controlled to a temperature suitable for the type of sheet 9 by the controller 7. The sheet 9 on which the image has been fixed by the fixing unit 17 is ejected to the body space 6 via discharge rollers 18.

Figure 2:
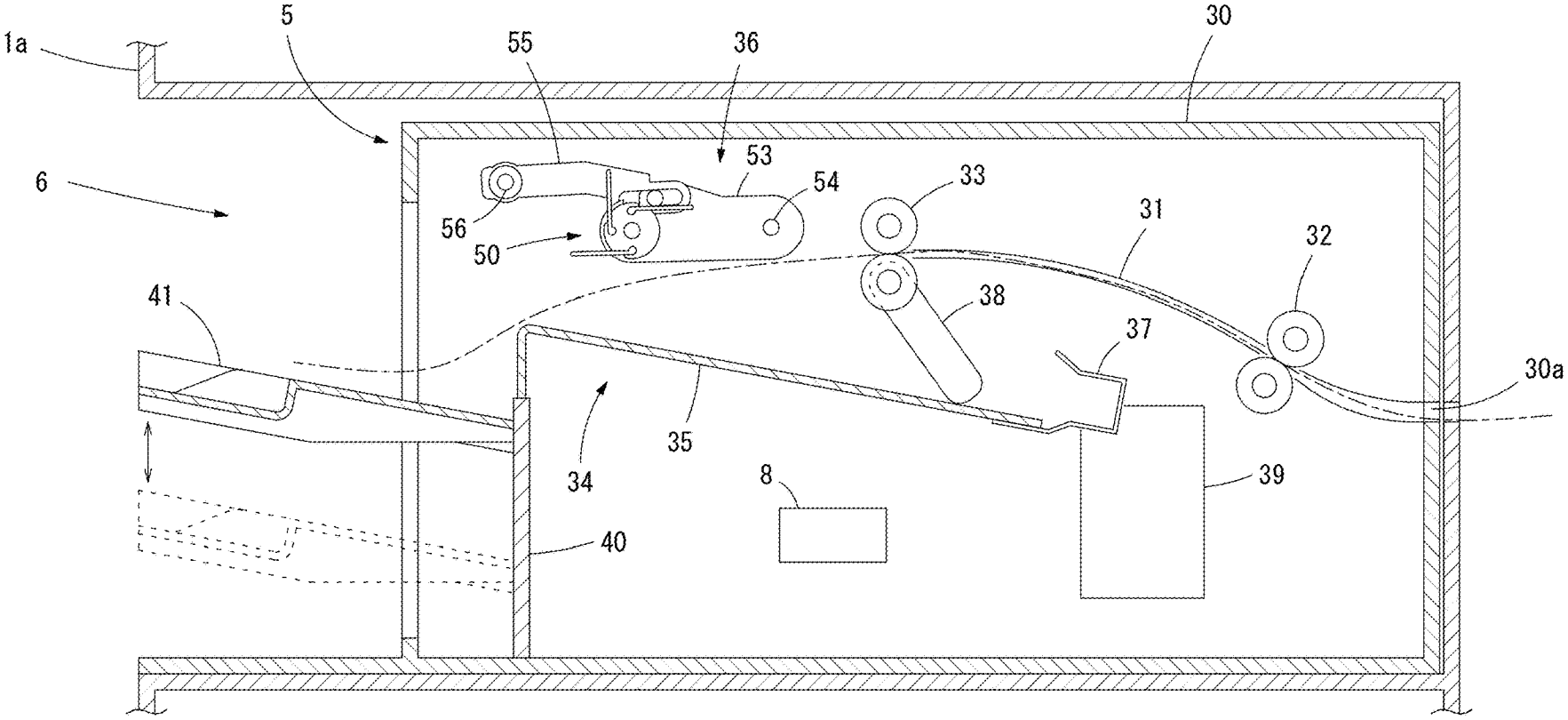
FIG. 2 is a diagram illustrating a configuration example of a sheet processing apparatus.

The sheet processing apparatus 5 receives the sheet 9 discharged from the printer unit 4 as described above and aligns and discharges the plurality of sheets 9. FIG. 2 is a diagram illustrating an example of a configuration of the sheet processing apparatus 5. The sheet processing apparatus 5 includes a housing 30, a conveyance path 31, conveyance rollers 32 and 33, a sheet alignment unit 34, a post-processing unit 39, a sheet discharge tray 41, and a controller 8. The conveyance path 31, the conveyance rollers 32 and 33, the sheet alignment unit 34, and the post-processing unit 39 are accommodated in the housing 30. A carry-in port 30*a* for receiving the sheet 9 is provided on the right-side wall of the housing 30. The sheet processing apparatus 5 receives the sheet 9, on which an image is formed, and which is discharged from the image forming apparatus 1, from the carry-in port 30*a*, and conveys the sheet 9 along the conveyance path 31 inside the housing 30. The conveyance rollers 32 and 33 are formed of a pair of rollers positioned above and below across the conveyance path 31 and convey the sheet 9 toward the sheet alignment unit 34.

In a case where the post-processing is not performed on the sheet 9, the sheet processing apparatus 5 conveys the sheet 9 discharged from the conveyance roller 33 positioned on the most downstream side of the conveyance path 31 toward the sheet discharge tray 41 as it is, as indicated by a chain line in FIG. 2, and stacks the sheet 9 on the sheet discharge tray 41. The sheet discharge tray 41 is configured to be movable in the up-down direction along a wall portion 40 erected inside the housing 30, and the height position of the sheet discharge tray 41 can be adjusted in accordance with the number of stacked sheets 9. For example, the controller 8 lowers the sheet discharge tray 41 in accordance with the number of sheets 9 stacked on the sheet discharge tray 41.

On the other hand, when the post-processing is performed on the sheet 9, the sheet processing apparatus 5 operates the sheet alignment unit 34 to align the plurality of sheets 9. Then, the sheet processing apparatus 5 drives the post-processing unit 39 in a state where a predetermined number of sheets 9 are aligned, performs post-processing on the sheets 9, and discharges the sheets 9 onto the sheet discharge tray 41. The post-processing unit 39 performs, for example, a process of binding a plurality of sheets 9 with a staple. In the present embodiment, a process of binding a plurality of sheets 9 with a staple is exemplified as the post-processing by the post-processing unit 39. Provided that the post-processing by the post-processing unit 39 is not limited to the processing of binding with staples.

The sheet alignment unit 34 includes a tray 35 for aligning the plurality of sheets 9, a paddle holding portion 36 provided on the tray 35, a restricting member 37 provided at one end of the tray 35, and a sheet pressing portion 38.

An upper surface of the tray 35 is configured as a sheet placement surface on which the sheet 9 is placed. The sheet placement surface of the tray 35 is inclined. For example, the sheet placement surface of the tray 35 is formed so that a leading end side in a discharge direction of the sheet 9 discharged from the conveyance roller 33 is high and a trailing end side is low. The restricting member 37 is arranged on the side of the lower one end of the tray 35. The sheet alignment unit 34 aligns the rear end of the sheet 9 discharged from the conveyance roller 33 at the same position by bringing the rear end of the sheet 9 into contact with the restricting member 37. For example, a plurality of the restricting member 37 are disposed along the width direction of the tray 35. The post-processing unit 39 is disposed between the plurality of restricting member 37, and staples end portions of the plurality of sheets 9 in a state of being in contact with the restricting member 37 and being aligned.

A sheet pressing portion 38 presses the front surface of the sheet 9 when the sheet 9 abuts against the restricting member 37. The sheet pressing portion 38 is loosely inserted into, for example, a rotation shaft of a roller that is arranged on a lower side in a pair of rollers that form the conveyance roller 33 and is swingable around the rotation shaft.

The paddle holding portion 36 holds a paddle member 50. The paddle member 50 is held by the paddle holding portion 36 so as to be movable up and down on the tray 35. FIG. 2 illustrates a state in which the paddle member 50 has risen to a retracted position on the tray 35. This retreat position is a home position of the paddle member 50. When the sheet 9 is conveyed onto the tray 35, the paddle holding portion 36 lowers the paddle member 50 so as to approach the upper surface of the tray 35 and hits and drops the sheet 9 onto the tray 35. Further, the paddle holding portion 36 conveys the sheet 9 downward in the inclination direction of the tray 35 by rotating the paddle member 50, so that the rear end of the sheet 9 abuts against the restricting member 37.

The paddle holding portion 36 includes a holding member 53 that holds the paddle member 50, and a swing arm 55. A base end part of the holding member 53 is attached to a rotation shaft 54. The holding member 53 is rotatably supported by the rotation shaft 54. The holding member 53 rotatably holds the paddle member 50 at its tip end portion. The holding member 53 swings about the rotation shaft 54 to adjust the height position of the paddle member 50 with respect to the upper surface of the tray 35. The swing arm 55 has a base end portion fixed to a rotation shaft 56 and swings a tip end portion in an up/down direction with rotation of the rotation shaft 56. A distal end portion of the swing arm 55 is engaged with a distal end portion of the holding member 53. Therefore, when the swing arm 55 causes the tip end portion to swing in the up/down direction with the rotation of the rotation shaft 56, the holding member 53 swings around the rotation shaft 54 with the swing, and the height position of the paddle member 50 held by the tip end portion of the holding member 53 changes.

Figure 3:
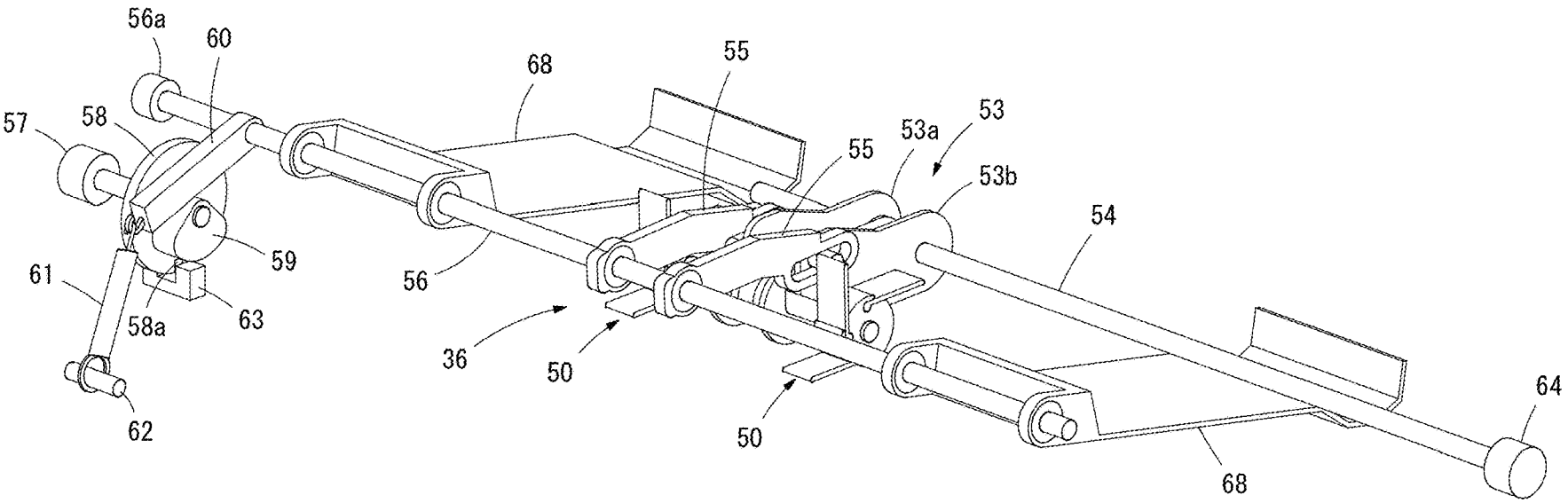
FIG. 3 is a perspective view illustrating details of a drive mechanism of a paddle holding portion.
Figure 4:
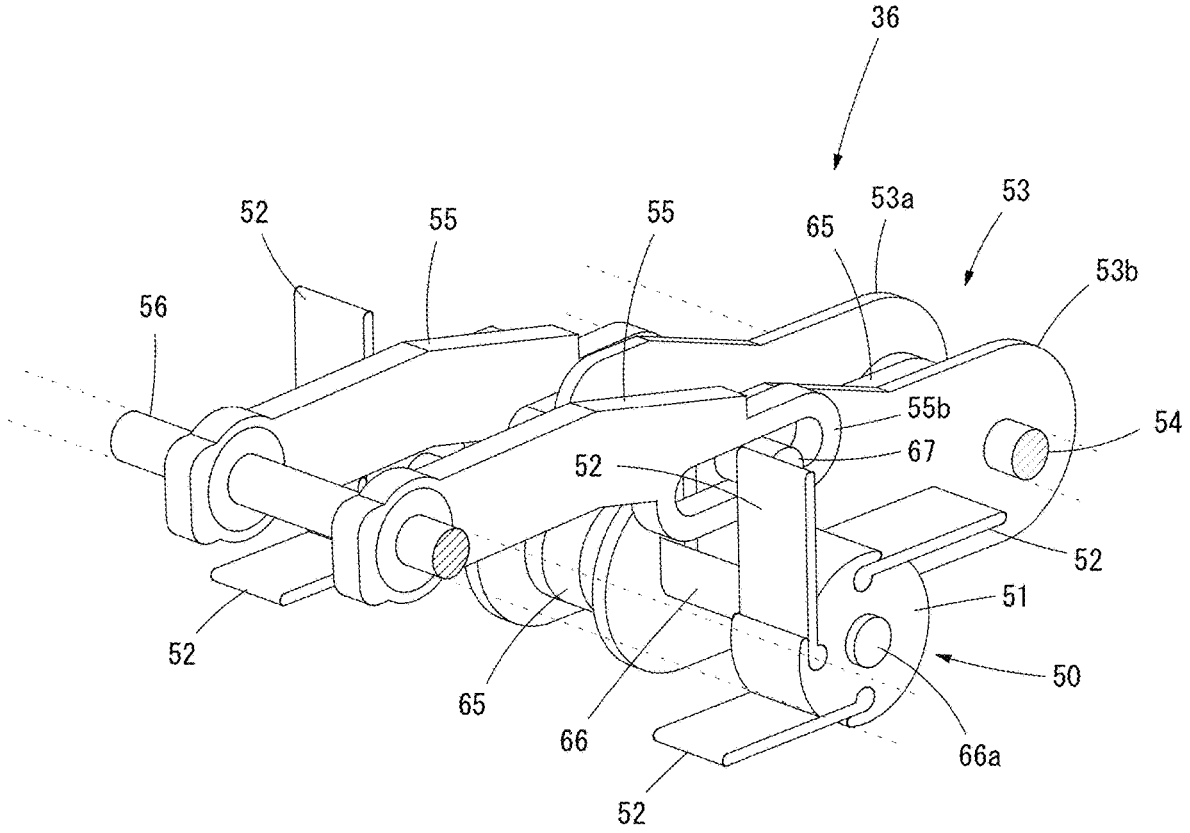
FIG. 4 is an enlarged perspective view of the paddle holding portion.
Figure 5:
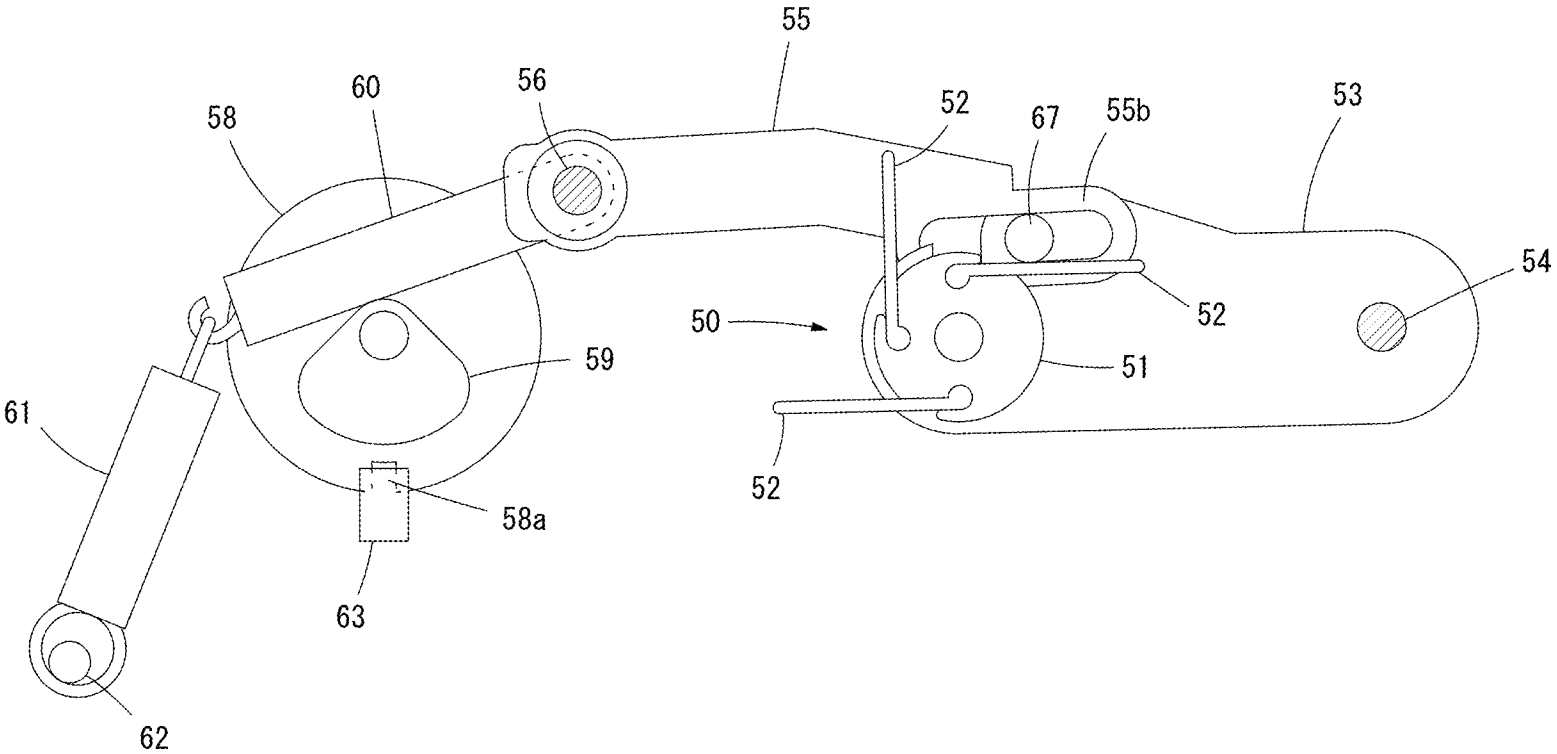
FIG. 5 is a side view illustrating a drive mechanism of the paddle holding portion.

A detailed configuration of the paddle holding portion 36 will be described. FIG. 3 is a perspective view illustrating details of a drive mechanism of the paddle holding portion 36. FIG. 4 is an enlarged perspective view illustrating the paddle holding portion 36. FIG. 5 is a side view illustrating a drive mechanism of the paddle holding portion 36.

As shown in FIG. 3, an end portion of the rotation shaft 56 supporting the swing arm 55 is rotatably supported by a shaft receiving portion 56*a* provided in the housing 30. The paddle holding portion 36 is provided at a longitudinally central position of the rotation shaft 56. Further, the rotation shaft 56 has lever members 68 and 68 on both sides of the paddle holding portion 36. The lever members 68 and 68 swing in the vertical direction with the rotation of the rotation shaft 56. These lever members 68 and 68 have a function of knocking down the sheet 9 conveyed onto the tray 35 onto the upper surface of the tray 35.

As shown in FIG. 3, a rotary disk 58 rotated by a motor 57 is provided on one end side of the rotation shaft 56. As shown in FIG. 3 and FIG. 5, a cam 59 is formed on the rotary disk 58. The rotary disk 58 has a cutout portion 58*a* at a predetermined position of an outer peripheral edge. In addition, a position detection sensor 63 which detects the cutout portion 58*a* is provided on the outer side of the rotary disk 58.

A rod-shaped follower 60 is fixed to one end side of the rotation shaft 56. One end of the follower 60 is fixed to the outer peripheral surface of the rotation shaft 56. The follower 60 abuts against the upper edge of the cam 59. An urging member 61, such as a tension spring, is attached to the other end of the follower 60. One end of the urging member 61 is fixed to the follower 60, and the other end is fixed to an attachment portion 62 provided in the housing 30. The urging member 61 pulls and urges the other end of the follower 60 downward. Therefore, the follower 60 changes its posture with its middle portion in contact with the upper edge portion of the cam 59. When the motor 57 rotates the rotary disk 58, the cam 59 rotates correspondingly. Along with this, the follower 60 swings around the rotation shaft 56 to change its posture. Along with the posture change of the follower 60, the rotation shaft 56 rotates within a range of a predetermined angle. As a result, the swing arm 55 swings in the vertical direction.

A motor 64 is connected to one end of the rotation shaft 54 supporting the holding member 53. The motor 64 rotates the rotation shaft 54. As illustrated in FIG. 4, the holding member 53 includes a pair of plate members 53*a* and 53*b* disposed at a predetermined interval. The rotation shaft 54 is loosely inserted into holes provided in the base end portions of the pair of plate members 53*a* and 53*b* and holds the base end portions of the plate members 53*a* and 53*b* at predetermined positions. In the holding member 53, a drive belt 65 is disposed between the pair of plate members 53*a* and 53*b*. As the rotation shaft 54 rotates, the drive belt 65 circulates between the pair of plate members 53*a* and 53*b* to rotate a rotation shaft 66 that pivotally support the paddle member 50. That is, the motor 64 is provided as a drive source that rotates the paddle member 50.

Further, each of the pair of plate members 53*a* and 53*b* has a projecting portion 67 projecting outward at a distal end portion thereof. The swing arm 55 is provided with a long hole in its tip part 55*b* and is engaged with the tip end portion of the holding member 53 by accommodating the projecting portion 67 in the long hole. Thus, the swing arm 55 swings about the rotation shaft 56 within a range of a predetermined angle, so that the distal end portion of the holding member 53 can be moved up and down.

As illustrated in FIG. 4, the paddle member 50 are provided on both right and left sides with the holding member 53 interposed therebetween. The paddle member 50 includes a rotor 51 and a plurality of fins 52 protruding outward from the outer peripheral surface of the rotor 51. The rotor 51 is a cylindrical member, and one end 66*a* of a rotation shaft 66 is attached to the center of the rotor 51, so that the rotor 51 rotates integrally with the rotation shaft 66. The fins 52 are formed of an elastic body, such as rubber, and is elastically deformed. The present embodiment shows an example in which three fins 52 are attached to the periphery of the rotor 51. As the motor 64 is driven and the rotation shaft 66 rotates, the paddle member 50 causes the plurality of fins 52 to rotate in a predetermined direction. At this time, the fins 52 of the paddle member 50 comes into contact with the sheet 9 placed on the tray 35 and applies a conveying force for conveying the sheet 9 downward in the inclination direction of the tray 35.

Figure 6:
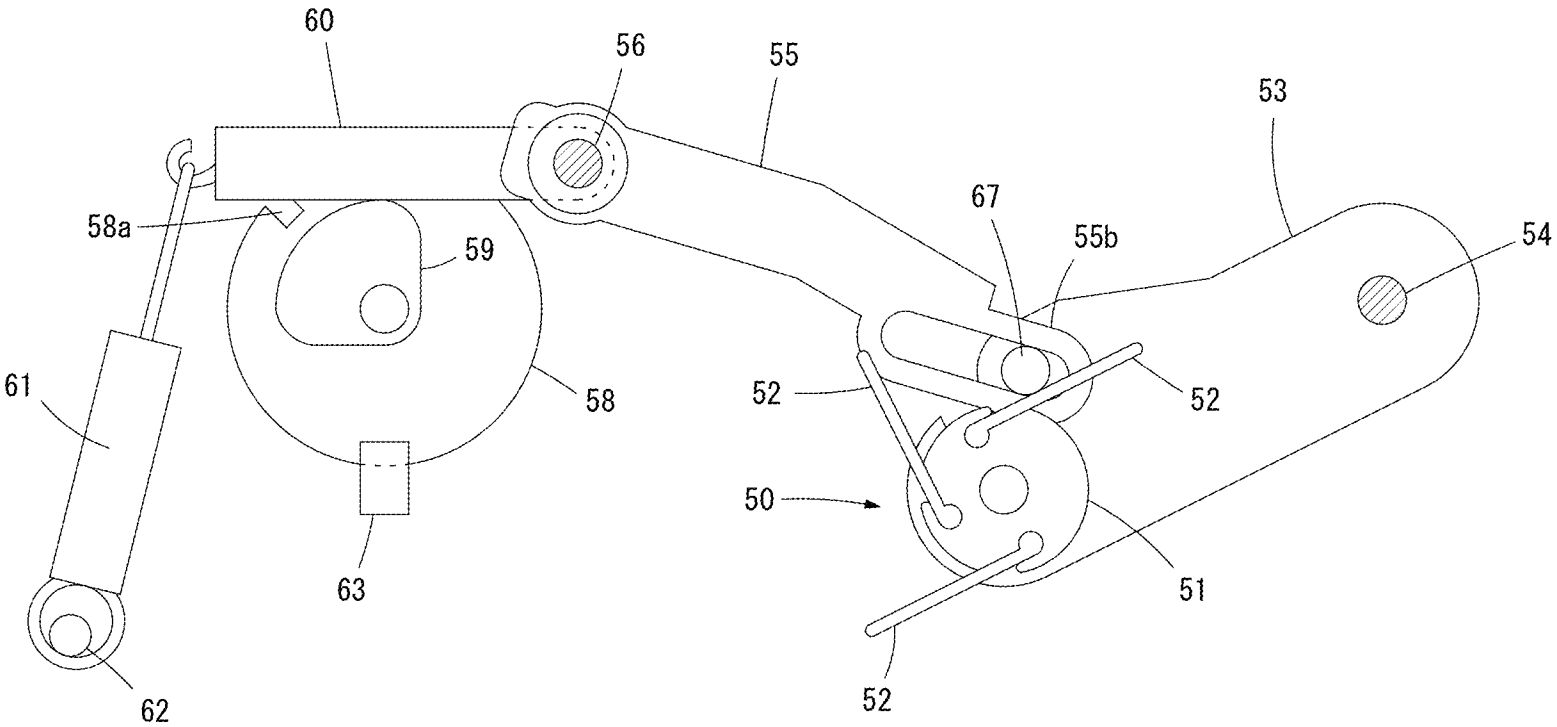
FIG. 6 is an enlarged view illustrating a state where the paddle member is lowered.
Figure 7:
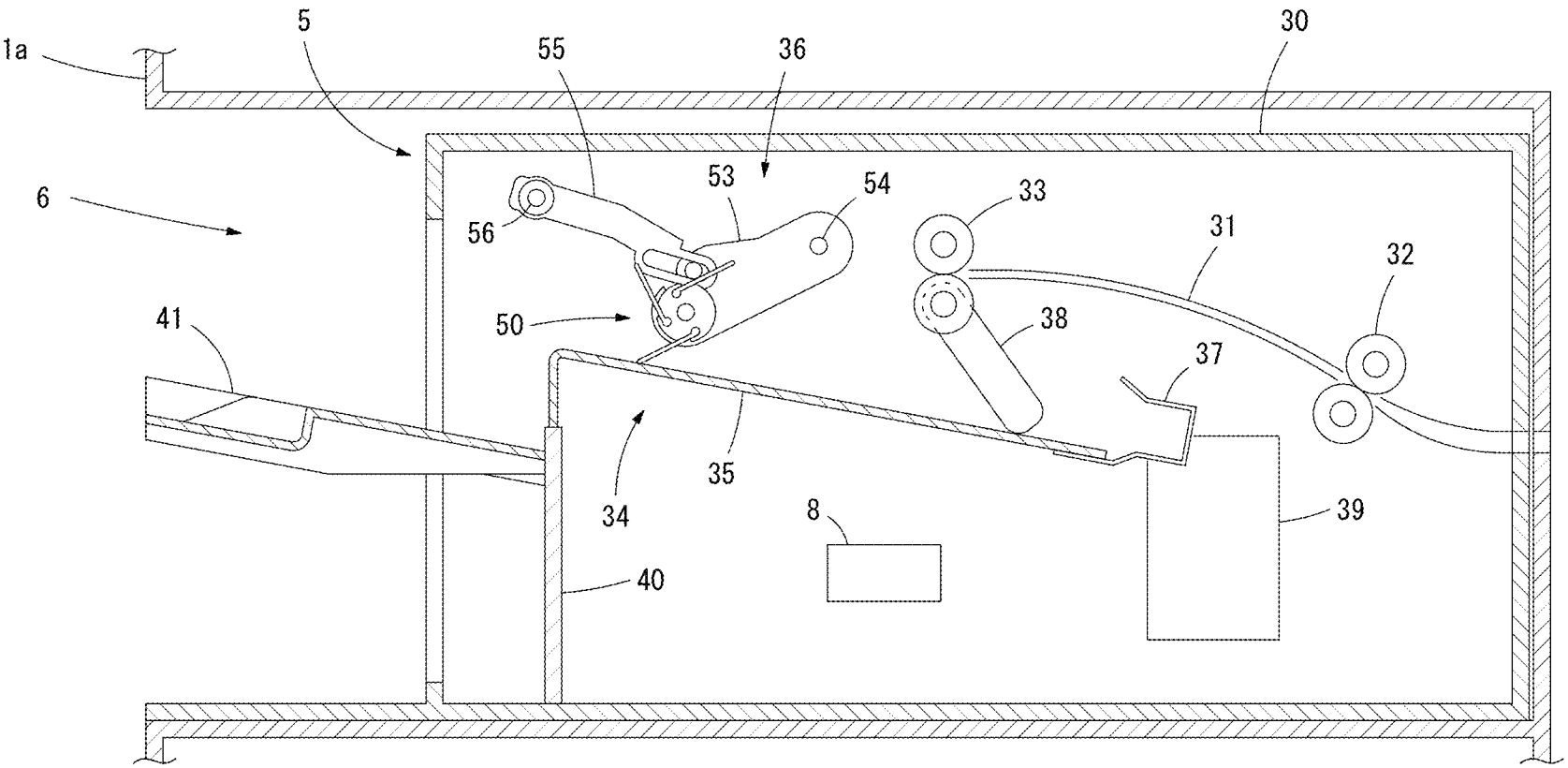
FIG. 7 is a view illustrating the sheet processing apparatus in a state where the paddle member is lowered.

FIG. 6 is an enlarged view illustrating a state in which the paddle member 50 is lowered. FIG. 7 is a view illustrating the sheet processing apparatus 5 in a state in which the paddle member 50 is lowered. As illustrated in FIG. 6, when the rotary disk 58 rotates and the cam 59 pushes up the follower 60, the rotation shaft 56 rotates by a predetermined angle. Along with this, the swing arm 55 lowers the tip part 55*b*. As the tip end portion 2*b* of the swing arm 55 descends, the holding member 53 causes the paddle member 50 to descend and come close to the upper surface of the tray 35. When the paddle member 50 descends while rotating counterclockwise, the plurality of fins 52 having elasticity sequentially come into contact with the sheet 9 to apply a conveying force to the sheet 9. By this conveying force, the sheet 9 is conveyed on the tray 35 toward a restricting member 37 and is aligned in a state in which a trailing end of the sheet 9 is abutted against the restricting member 37.

Figure 8:
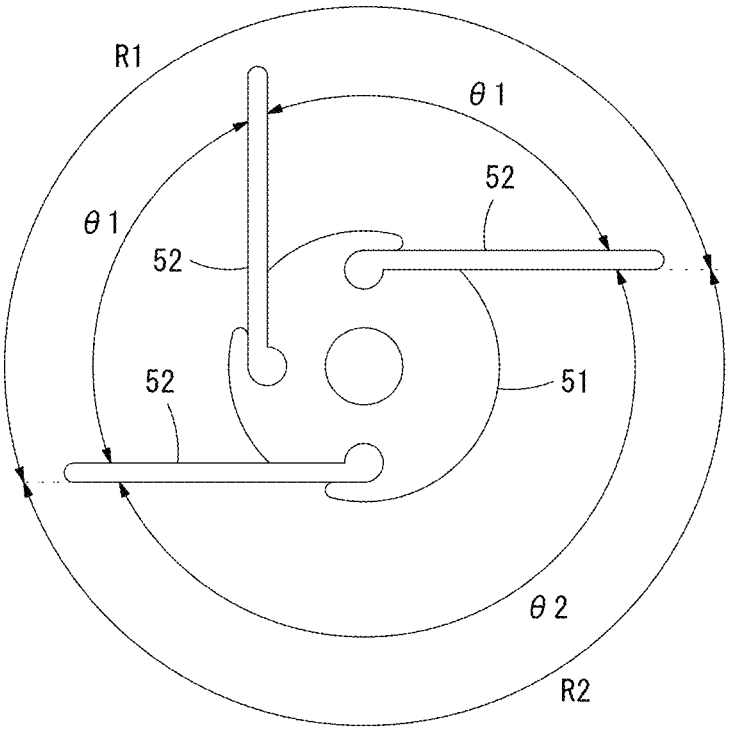
FIG. 8 is a diagram illustrating an example of arrangement of a plurality of fins provided on an outer peripheral surface of the paddle member.

FIG. 8 is a diagram illustrating an example of arrangement of the plurality of fins 52 provided on the outer circumferential surface of the paddle member 50. The paddle member 50 is provided with three fins 52 on the outer peripheral surface of the rotor 51. Three fins 52 are not provided uniformly over the entire outer peripheral surface of the rotor 51. That is, the paddle member 50 includes, on the outer peripheral surface of the rotor 51, a fin formed portion R1 in which the fins 52 are formed and a fin non-formed portion R2 in which the fins 52 are not formed. For example, the fin formed portion R1 is formed in a region of about half the circumference of the outer circumferential surface of the rotor 51, and the fin-non-formed portion R2 is also formed in a region of about half the circumference of the outer circumferential surface of the rotor 51. In the fin formed portion R1, three fins 52 are formed at intervals of a predetermined angle θ1. On the other hand, the fin-non-formed portion R2 is formed in a range of a predetermined angle θ2. Therefore, when the rotor 51 is rotated in a state where the paddle member 50 is lowered toward the tray 35, a period in which the fins 52 abut on the sheet 9 and a period in which the fins 52 do not abut on the sheet 9 are generated. The conveying force is not applied to the sheet 9 in a period in which the fins 52 do not abut on the sheet 9. On the other hand, the conveying force is applied to the sheet 9 in a period in which the fins 52 abut on the sheet 9. The paddle member 50 conveys the sheet 9 toward the restricting member 37 by periodically generating a period in which the fins 52 abut on the sheet 9 and a period in which the fins 52 do not abut on the sheet 9.

When coming into contact with the sheet 9 placed on the tray 35, the three fins 52 provided on the paddle member 50 are elastically deformed to generate a frictional force with the sheet 9. This frictional force is applied to the sheet 9 as a conveying force for conveying the sheet 9. The paddle member 50 is configured not to interfere with other adjacent fins 52 when any one of the three fins 52 abut on the sheet 9 and is elastically deformed. This prevents the plurality of fins 52 from simultaneously coming into contact with the sheet 9. If the plurality of fins 52 come into contact with the sheet 9 at the same time, the conveying force of the sheet 9 becomes too large, and the trailing end of the sheet 9 abuts against the restricting member 37 and is buckled. In order to prevent this, the paddle member 50 is configured such that even if each of the fins 52 is elastically deformed, the fins 52 do not interfere with another adjacent fins 52.

The controller 8 of the sheet processing apparatus 5 controls the operation of aligning the sheet 9 discharged from the image forming apparatus 1 on the tray 35. FIG. 9A, FIG. 9B, FIG. 9C, FIG. 10A, and FIG. 10B are diagrams exemplifying the sheet alignment operation by the controller 8.

Figure 9A:
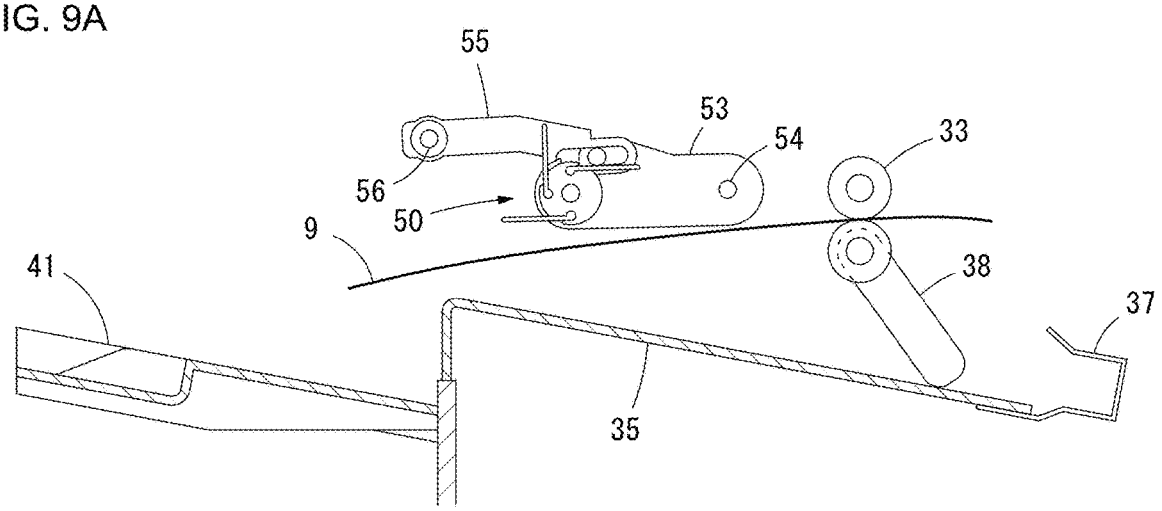
FIGS. 9A, 9B, and 9C are diagrams illustrating a sheet alignment operation by a controller.
Figure 9B:
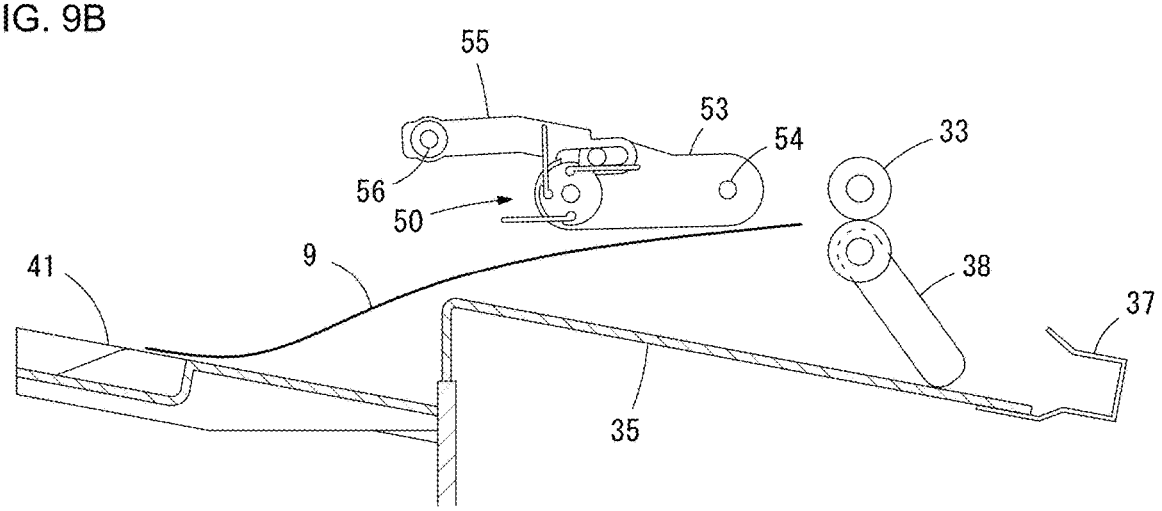
Figure 9C:
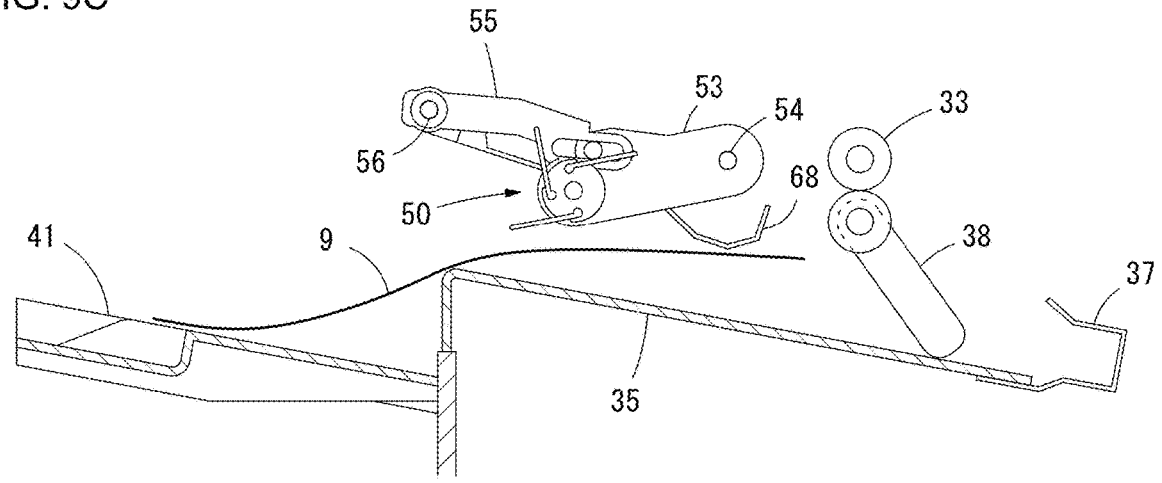

As illustrated in FIG. 9A, the controller 8 allows the sheet 9 discharged from the image forming apparatus 1 to be received in a state where the paddle member 50 is raised to the retracted position. Thereafter, as illustrated in FIG. 9B, when the trailing end of the sheet 9 is discharged onto the tray 35, the controller 8 starts the operation of lowering the paddle member 50 from the retracted position. As the paddle member 50 descends, the sheet 9 discharged onto the tray 35 hits the paddle member 50 and the lever member 68 as shown in FIG. 9C and is forcibly knocked down onto the tray 35.

Figure 10A:
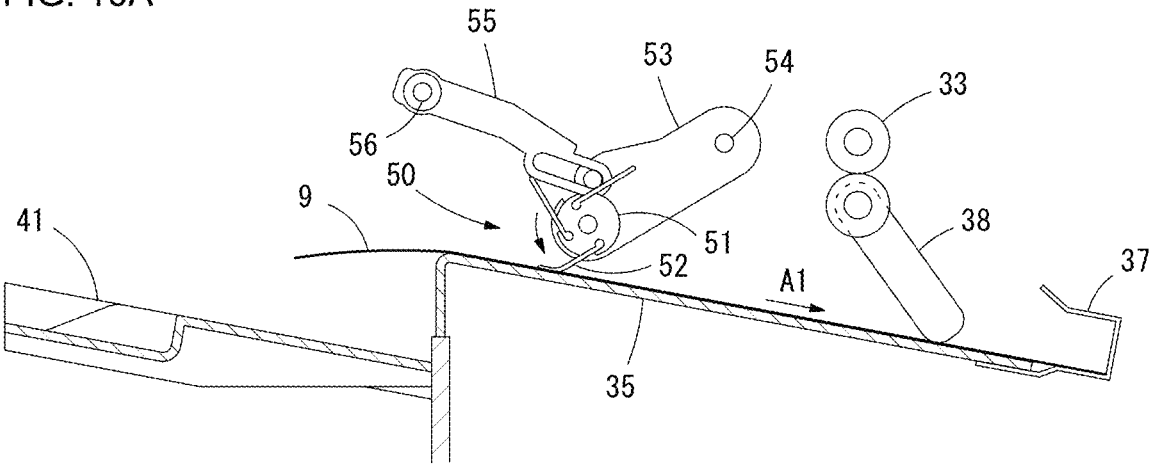
FIG. 10A and FIG. 10B are diagrams illustrating the sheet alignment operation by the controller.
Figure 10B:
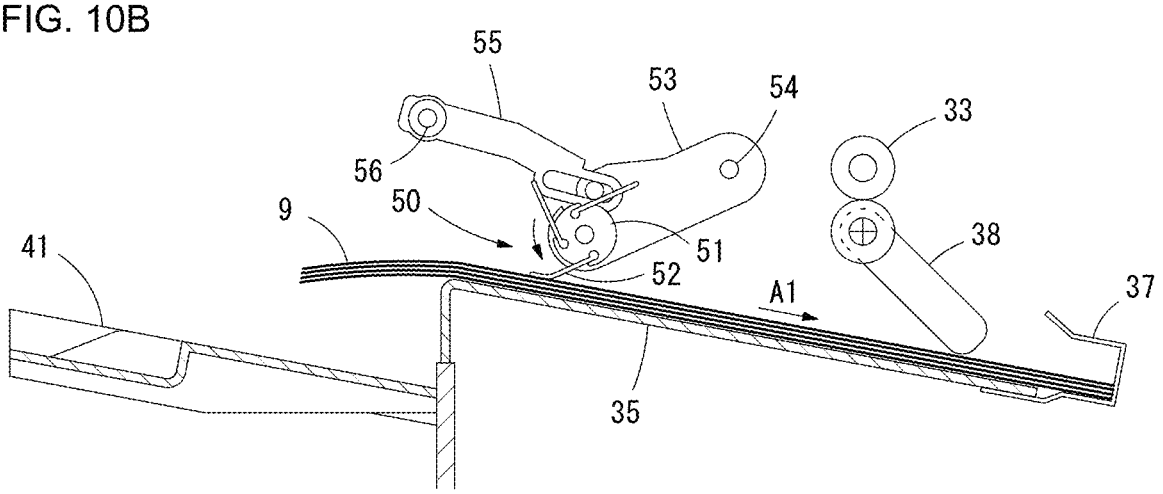

The controller 8 rotationally drives the paddle member 50 in accordance with the start of the lowering of the paddle member 50. The timing at which the rotational driving of the paddle member 50 is started may be the same as the lowering start timing of the paddle member 50 or may be a timing at which a predetermined time has elapsed from the lowering start timing of the paddle member 50. Further, the controller 8 determines the height position of the paddle member 50 and stops the lowering operation of the paddle member 50 when the paddle member 50 is lowered to the determined height position. After the lowering operation of the paddle member 50 is stopped, the controller 8 continues the operation of rotating the paddle member 50. At this time, as shown in FIG. 10A, the fins 52 provided on the paddle member 50 comes into contact with the upper surface of the sheet 9 and rotates in an elastically deformed state. As the paddle member 50 rotate, the sheet 9 moves in the direction indicated by the arrow A1, and the rear end of the sheet 9 comes into contact with the restricting member 37. Thereafter, the controller 8 moves up the paddle member 50 to the retreat position so as to be ready to receive the next sheet 9. The controller 8 repeats the above-described operation to stack the plurality of sheets 9 on the tray 35 in an aligned state as shown in FIG. 10B.

The sheet processing apparatus 5 as described above is mounted in a body space 6 of the apparatus body 1*a* of the image forming apparatus 1. Therefore, as compared with a puddle member mounted on a post-processing apparatus arranged side by side adjacent to the image forming apparatus 1, the puddle member 50 incorporated in the sheet processing apparatus 5 is reduced in size, and the outer diameter of the puddle member 50 is reduced in diameter. Therefore, when the root portion of the fins 52 come into contact with the sheet 9 at the time of alignment of the sheet 9, the conveying force becomes too large, and there is a possibility that the sheet 9 buckles. Further, when the sheet 9 is aligned, if only the tip end portion of the fins 52 come into contact with the sheet 9, a sufficient conveying force cannot be applied to the sheet 9, which may cause alignment failure.

Therefore, when driving the paddle member 50, the controller 8 of the present embodiment performs control such that an appropriate conveying force is applied to the sheet 9. Specifically, the controller 8 determines the height position of the paddle member 50 on the tray 35 based on the number of sheets 9 stacked on the tray 35 and the sheet information of the sheet 9 to be conveyed. Then, based on the determined height position, the controller 8 controls the height position of the paddle member 50 such that an appropriate conveying force is applied to the sheet 9. Hereinafter, such the controller 8 will be described in detail.

Figure 11:
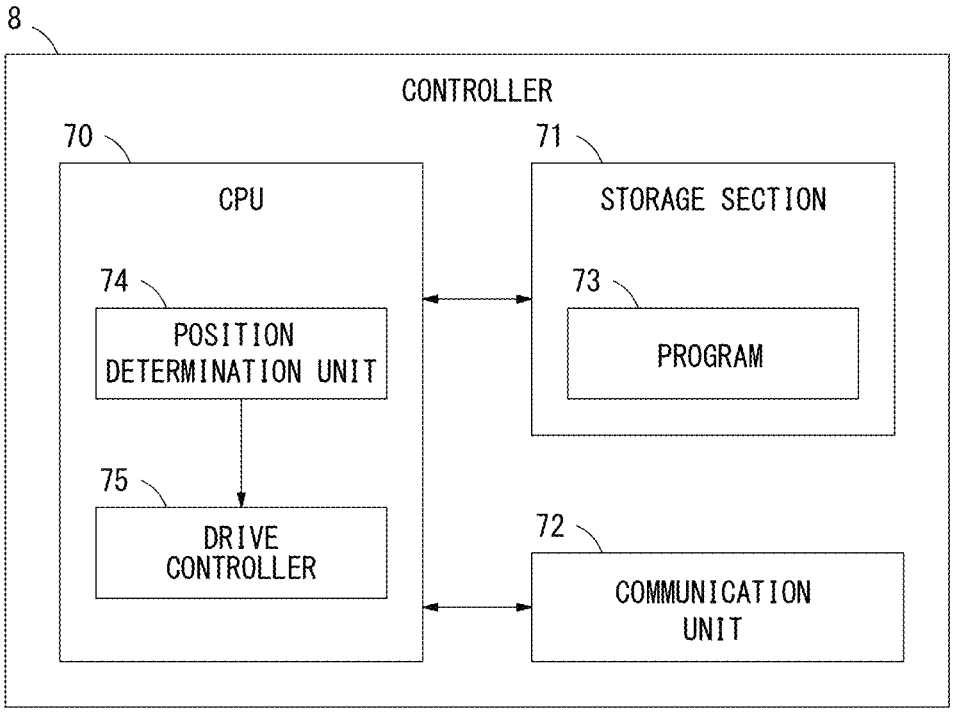
FIG. 11 is a block diagram illustrating an example of the configuration of the controller.

FIG. 11 is a block diagram illustrating an example of a configuration of the controller 8. The controller 8 includes a CPU 70, a storage section 71, and a communication unit 72. The CPU 70 is a hardware processor that reads and executes a computer-readable program 73. The storage section 71 is a non-volatile storage device including a hard disk drive (HDD), a solid-state drive (SSD), or the like. The storage section 71 stores in advance a program 73 to be executed by the CPU 70. The communication unit 72 communicates with the controller 7 provided in the image forming apparatus 1.

The CPU 70 controls the operation of each section of the sheet processing apparatus 5 by executing the program 73. For example, the CPU 70 functions as a position determination unit 74 and a drive controller 75 by executing the program 73.

Figure 12:
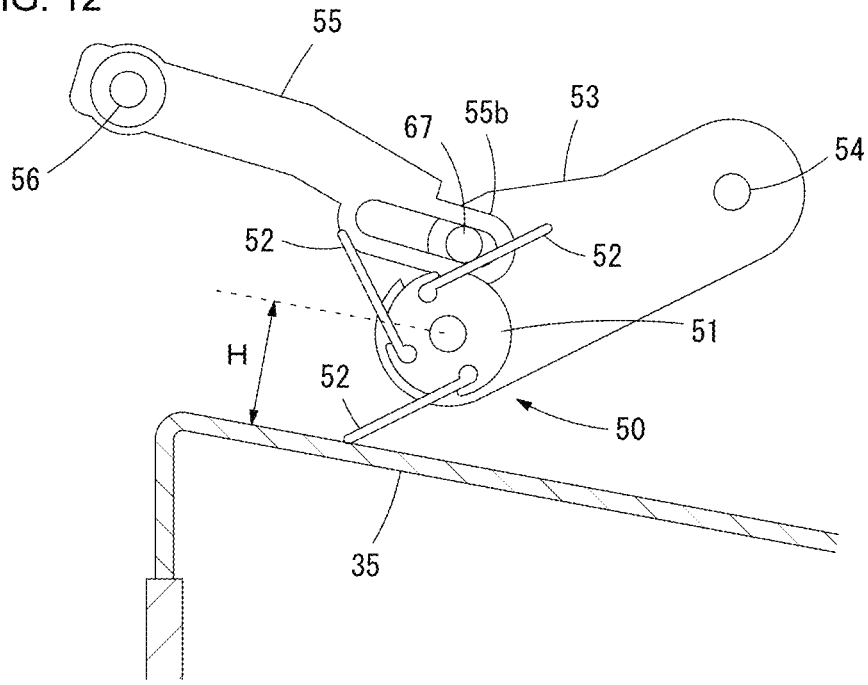
FIG. 12 is a diagram illustrating the height position of the paddle member determined by the position determination unit.

The position determination unit 74 determines the height position of the paddle member 50. FIG. 12 is a diagram illustrating the height position H of the paddle member 50 determined by the position determination unit 74. As shown in FIG. 12, the position determination unit 74 determines the distance between the upper surface of the tray 35 and the rotation center of the rotor 51 in the normal direction of the tray 35 as the height position H of the paddle member 50.

For example, every time the sheet 9 is conveyed from the image forming apparatus 1, the position determination unit 74 determines the height position H of the paddle member 50 at which an optimum conveying force can be applied to align the sheet 9. The position determination unit 74 determines the height position of the paddle member 50 in accordance with the number of sheets 9 stacked on the tray 35 in order to apply an appropriate conveying force to the sheet 9 placed on the tray 35 by the small-diameter paddle member 50.

Further, the height position of the uppermost sheet 9 stacked on the tray 35 varies depending on the thickness of the sheet 9. Therefore, the position determination unit 74 acquires the sheet information from the controller 7 of the image forming apparatus 1 via the communication unit 72 and determines the height position H of the paddle member 50 based on the sheet information. As described above, when the sheet 9 is conveyed along the conveyance path 13, the controller 7 acquires the detection result by the medium detecting unit 14 as sheet information and sends the sheet information to the sheet processing apparatus 5. Therefore, the position determination unit 74 can determine the height position H of the paddle member 50 based on the sheet information of the sheet 9 being conveyed in the image forming apparatus 1.

Figure 13:
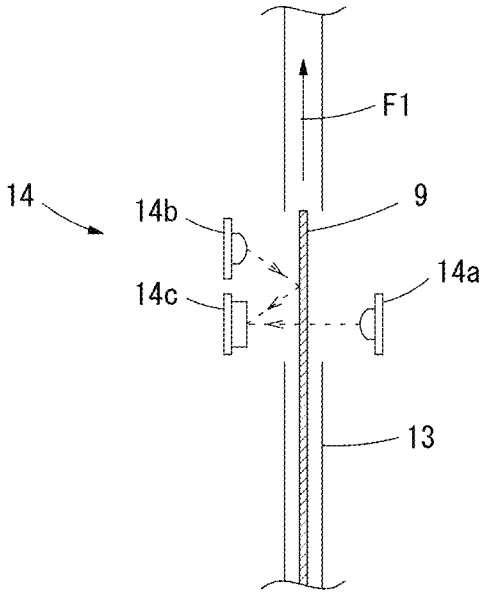
FIG. 13 is a diagram illustrating a configuration example of a medium detecting unit.

FIG. 13 is a view illustrating an example of a configuration of the medium detecting unit 14. The medium detecting unit 14 includes a transmission light source 14*a*, a reflection light source 14*b*, and a light receiving device 14*c*. The transmission light source 14*a* are arranged on one side of the conveyance path 13 of the sheet 9. The reflection light source 14*b* and the light receiving device 14*c* are arranged on the other side of the conveyance path 13 of the sheet 9. For example, the light receiving device 14*c* are provided at positions facing the transmission light source 14*a* with the conveyance path 13 interposed therebetween. While the sheet 9 is being conveyed through the conveyance path 13, the medium detecting unit 14 alternately turns on the transmission light source 14*a* and the reflection light source 14*b*. When the transmission light source 14*a* are turned on, the light receiving device 14*c* detect light transmitted through the sheet 9. When the reflection light source 14*b* are turned on, the light receiving device 14*c* detect light reflected by the sheet 9. The light transmittance varies depending on the thickness (basis weight) of the sheet 9. The reflectance of the sheet 9 varies depending on the surface condition of the sheet 9. Therefore, the medium detecting unit 14 can detect the physical properties of the sheet 9 by sequentially turning on the transmission light source 14*a* and the reflection light source 14*b* and detecting the transmitted light and the reflected lights with the light receiving device 14*c*. The physical properties of the sheet 9 include a thickness (basis weight) and a surface state of the sheet 9. The controller 7 of the image forming apparatus 1 generates sheet information indicating the physical properties of the sheet 9 based on the detection result of the medium detecting unit 14 and sends the sheet information to the controller 8 of the sheet processing apparatus 5. The sheet information transmitted from the controller 7 includes at least thickness information of the sheet 9.

The position determination unit 74 determines the height position H of the paddle member 50 based on the number of sheets 9 stacked on the tray 35 and the thickness information of the sheet 9 such that the distance between the paddle member 50 and the uppermost sheet 9 of the sheet bundle stacked on the tray 35 is maintained at a constant distance. For example, when the first sheet 9 is conveyed to the sheet processing apparatus 5 after the image forming apparatus 1 starts the execution of the print job, the position determination unit 74 calculates the height position H1 of the paddle member 50 for aligning the first sheet 9 based on the following formula (1).

$$H1 = t1 + h1 \qquad \text{Formula (1)}$$

In the formula (1), "t1" is thicknesses of the first sheet 9. The position determination unit 74 substitutes the value of the t1 based on the thickness information included in the sheet information of the first sheet 9. Therefore, the value of t1 varies depending on the type of the sheet 9 (thin paper, plain paper, or thick paper). For example, values such as t1=0.066 [mm] when the sheet 9 is thin paper, t1=0.089 [mm] when the sheet 9 is plain paper, and t1=0.15 [mm] when the sheet 9 is thick paper are substituted.

In the formula (1), "h1" is a reference height position set in advance in accordance with the type of the sheet 9 such as thin paper, plain paper, or thick paper. For example, in a case where the sheet 9 is plain paper or thick paper, it is necessary to increase the conveying force by the paddle member 50 to some extent. On the other hand, in a case where the sheet 9 is thin paper, when the conveyance force by the paddle member 50 becomes too large, the sheet 9 may be buckled. Therefore, when the sheet 9 is plain paper or thick paper, a value such as h1=11.4 [mm] is set, and when the sheet 9 is thin paper, a value such as h1=12.4 [mm] is set.

Further, when the second and subsequent sheets 9 are conveyed to the sheet processing apparatus 5, the position determination unit 74 determines the height position Hn of the paddle member 50 for aligning the second and subsequent n-th sheets 9 based on the following formula (2).

$$Hn = \sum_{i=2}^{n} ti + H1 + hc \qquad \text{Formula (2)}$$

In the above formula (2), "ti" is the thickness of the i-th sheet 9. The position determination unit 74 substitutes the value of ti based on the thickness information of the i-th sheet 9. The H1 is a height position of the paddle member 50 when the first sheet 9 is aligned, which is calculated by formula (1).

In the above formula (2), "hc" is a correction term to be set when the type of the sheet 9 conveyed from the image forming apparatus 1 is switched during execution of a print job. For example, when the sheet 9 is switched from plain paper or thick paper to thin paper during the execution of the print job, hc=+1 [mm] is set. When the sheet 9 is changed from the plain paper or the thick paper to the thin paper, it is necessary to reduce the conveying force by the paddle member 50 in order to prevent buckling of the sheet 9. Therefore, it is necessary to increase the height position of the paddle member 50, and hc=+1 [mm] is set. Further, for example, when the sheet 9 is switched from the thin paper to the plain paper or the thick paper during the execution of the print job, hc=−1 [mm] is set. When the thin paper is switched to the plain paper or the thick paper, it is necessary to increase the conveying force by the paddle member 50 in order to appropriately align the sheet 9. Therefore, it is necessary to lower the height position of the paddle member 50, and hc=−1 [mm] is set. When the type of the sheet 9 is not switched during the execution of the print job, hc=0.

The position determination unit 74 calculates the height position of the paddle member 50 when the sheet 9 conveyed from the image forming apparatus 1 is aligned on the tray 35 based on the formulas (1) and (2) above. That is, the position determination unit 74 calculates the optimum height position of the paddle member 50 for the sheet 9 one by one.

Figure 14:
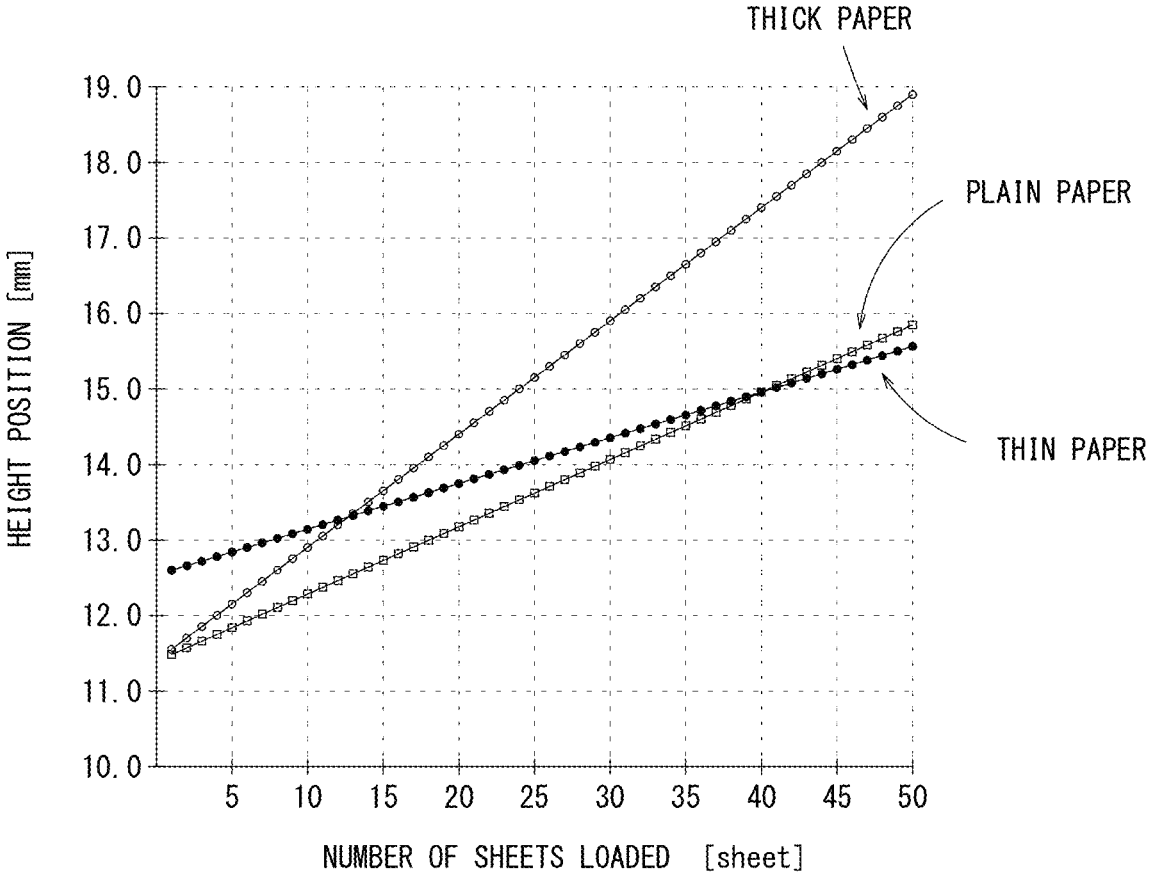
FIG. 14 is a diagram illustrating the change in height position of the paddle member as determined by the position determination unit.

FIG. 14 is a diagram illustrating a change in the height position of the paddle member 50 determined by the position determination unit 74. FIG. 14 illustrates a case where the type of the sheet 9 does not change during the execution of the print job. The position determination unit 74 determines the height position of the paddle member 50 each time the sheet 9 is received from the image forming apparatus 1. That is, the position determination unit 74 determines the height position at which an optimum conveying force can be applied to the sheet 9 one by one.

As shown in FIG. 14, when the sheet 9 is thick paper or plain paper, the height position of the paddle member 50 when the first sheet 9 is aligned is lower than that when the sheet 9 is thin paper. As a result, when the sheet 9 is thick paper or plain paper, the conveying force applied to the sheet 9 can be made larger than when the sheet 9 is thin paper, and it is possible to prevent an alignment failure in which the rear end of the sheet 9 does not reach the restricting member 37. Conversely, since the conveying force can be made smaller in a case where the sheet 9 is thin paper than in a case of plain paper or thick paper, it is possible to prevent the trailing end of the sheet 9 from strongly abutting against the restricting member 37 and buckling.

When the second and subsequent sheets 9 are aligned, the position determination unit 74 determines the height position of the paddle member 50 to be higher than the previous height position according to the thicknesses of the sheet 9 conveyed from the image forming apparatus 1. Thus, as illustrated in FIG. 14, as the number of sheets 9 stacked on the tray 35 increases one by one, the height position of the paddle member 50 gradually rises. Therefore, the downsized paddle member 50 can apply an optimum conveying force to the uppermost sheet 9 even in a state where a plurality of sheets 9 are stacked on the tray 35.

The position determination unit 74 may determine the height position of the paddle member 50 by sequentially performing the calculation of formula (1) or formula (2) every time the sheet 9 is conveyed from the image forming apparatus 1. However, the method of determining the height position by the position determination unit 74 is not limited thereto. For example, as shown in FIG. 14, the position determination unit 74 may hold a look-up table capable of determining the height position of the paddle member 50 in accordance with the type and the number of stacked sheets 9 and may determine the height position of the paddle member 50 by referring to the look-up table. In this case, since the time required for the arithmetic processing can be shortened, the position determination unit 74 can efficiently determine the height position of the paddle member 50.

There are various types of sheet 9 used for image formation in the image forming apparatus 1. For example, even when thick paper is used as the sheet 9, the basis weight of the thick paper has various values, such as 120 g/m$^2$, 200 g/m$^2$, 300 g/m$^2$. The number of sheets to be stacked on the tray 35 of the sheet processing apparatus 5 installed in the body space 6 of the image forming apparatus 1 is limited according to the basis weight. For example, in a case of thick paper having a basis weight of 120 g/m$^2$, the number of sheets stackable on the tray 35 is 30. For example, in a case of thick paper having a basis weight of 200 g/m$^2$, the number of sheets stackable on the tray 35 is 16. Further, for example, in the case of thick paper having a basis weight of 300 g/m$^2$, the number of sheets stackable on the tray 35 is 5. In such a case, the position determination unit 74 may determine the basis weight classification of the sheet 9 based on the thickness information of the sheet 9 and determine the height position of the paddle member 50 based on the basis weight classification. Here, the basis weight classification is a classification set according to the type of the sheet 9, such as thick paper, plain paper, and thin paper. For example, the sheet 9 having a basis weight of 120 g/m$^2$ or more corresponds to the basis weight classification of thick paper.

Figure 15:
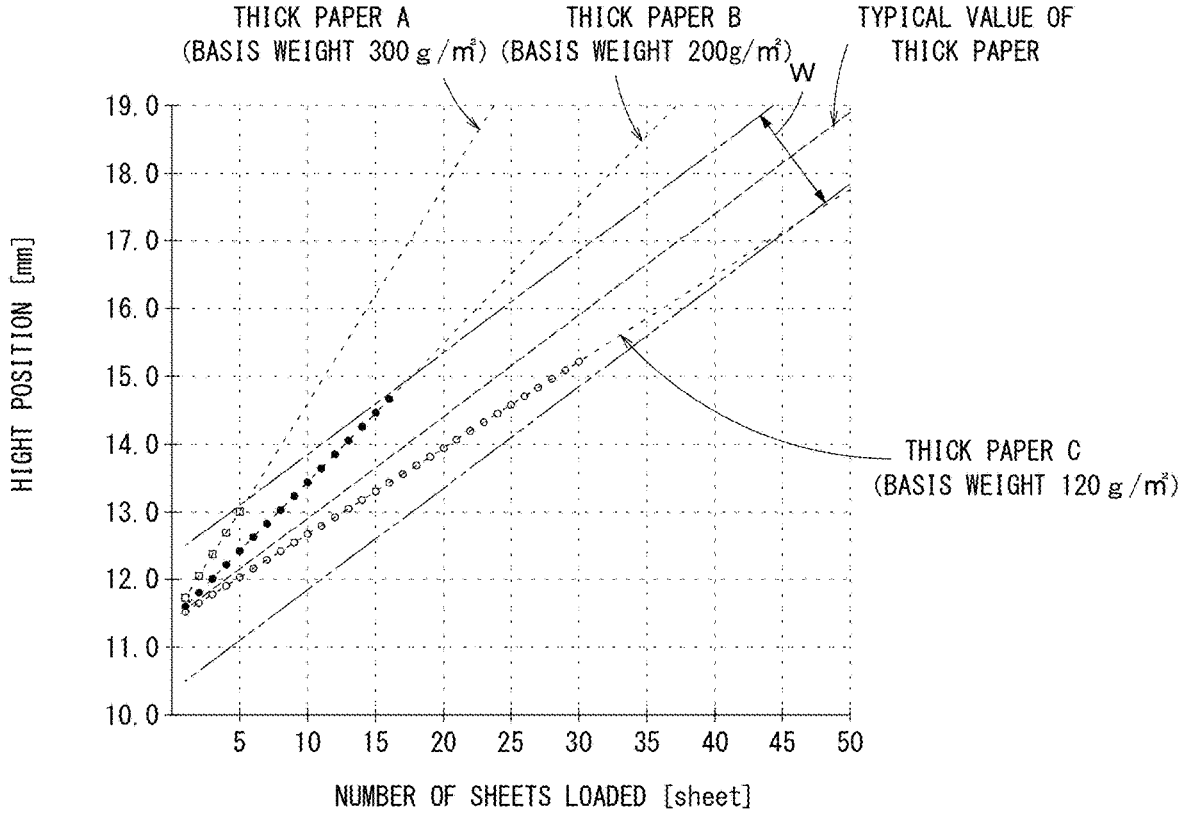
FIG. 15 is a diagram illustrating a representative value of the height position of the paddle member defined in the basis weight classification of a thick paper.

FIG. 15 is a diagram illustrating representative values of height positions of the paddle member 50 defined for a basis weight classification of thick paper. In the example shown in FIG. 15, as the number of sheets stackable on the tray 35, 5 sheets of thick paper A, 16 sheets of thick paper B, and 30 sheets of thick paper C are shown. When the sheet 9 is thick paper, a fluctuation in the conveying force due to a fluctuation in the height of the paddle member 50 is allowable within a certain range W such as a range of ±1 mm, for example. Therefore, when the basis weight class is thick paper, the position determination unit 74 determines the height position of the paddle member 50 based on the thick paper representative value which is the median value of the certain range W as illustrated in FIG. 15. In this case, when the position determination unit 74 determines that the sheet 9 is a thick sheet based on the thickness information of the sheet 9, the position determination unit 74 reads the thick sheet representative value corresponding to the number of stacked sheets on the tray 35 from the lookup table, and determines the height position of the paddle member 50 based on the read thick sheet representative value. Note that the position determination unit 74 may determine the height position by performing a calculation of substituting the number of stacked sheets into a linear function indicating the thick paper representative value. Further, in FIG. 15, only the basis weight classification of thick paper is illustrated, but the present invention is not limited to thick paper. For example, a plain paper representative value may be determined in advance for plain paper in the same manner as described above. Furthermore, a thin paper representative value may also be predetermined for thin paper.

Further, after determining the height position of the paddle member 50 based on the thickness information of the sheet 9 as described above, the position determination unit 74 may correct the height position of the paddle member 50 based on information different from the thickness information. The information different from the thickness information includes, for example, size information of the sheet 9, an image forming state on both front and back surfaces of the sheet 9, an amount of toner transferred to the sheet 9, temperature information, and humidity information.

When the sheet 9 having a large size is conveyed, a large conveying force is required to prevent the sheet 9 from not reaching the restricting member 37. On the other hand, when the sheet 9 having a small size is conveyed, it is necessary to reduce the conveying force in order to prevent buckling of the sheet 9 after the sheet 9 reaches the restricting member 37. Therefore, the position determination unit 74 corrects the height position of the paddle member 50 to be low or high in accordance with the size information of the sheet 9. Specifically, when the size of the sheet 9 is larger than a predetermined size, the position determination unit 74 corrects the height position of the paddle member 50 to be lower. Further, when the size of the sheet 9 is smaller than the predetermined size, the position determination unit 74 corrects the height position of the paddle member 50 to be higher. The size information of the sheet 9 is included in the sheet information.

Further, the position determination unit 74 corrects the height position of the paddle member 50 in accordance with the image forming state on both the front and back surfaces of the sheet 9. In a case where an image is formed only on one side of the sheet 9, the friction coefficient of the sheet 9 tends to increase on the side on which no image is formed, and a large conveying force is required to prevent the sheet from not reaching the restricting member 37. On the other hand, when images are formed on both the front and back surfaces of the sheet 9, the frictional force between the two sheets 9 is small, so that the sheet 9 tends to be easily conveyed even if the conveying force is small. For that reason, the position determination unit 74 corrects the height position of the paddle member 50 to be low in the case where the image is formed only on one surface of the sheet 9. Further, the position determination unit 74 corrects the height position of the paddle member 50 to be higher when images are formed on both the front and back surfaces of the sheet 9. Note that the controller 8 may acquire from the controller 7 of the image forming apparatus 1, information on the states of image formation on both the front and back sides of the sheet 9.

Further, the position determination unit 74 corrects the height position of the paddle member 50 in accordance with the amount of toner transferred to the sheet 9. In a case where the amount of toner transferred to the sheet 9 is small, the frictional force between the two sheets 9 becomes large, so that a large conveying force is required. On the other hand, in a case where the amount of toner transferred to the sheet 9 is large, the frictional force between the two sheets becomes small, so that it is necessary to reduce the conveying force. Therefore, the position determination unit 74 corrects the height position of the paddle member 50 to be low when the amount of toner is smaller than the predetermined amount. Further, when the toner amount is larger than the predetermined amount, the position determination unit 74 corrects the height position of the paddle member 50 to be higher. Note that the controller 8 may acquire information on the amount of toner transferred to the sheet 9 from the controller 7 of the image forming apparatus 1.

Furthermore, the position determination unit 74 corrects the height position of the paddle member 50 based on the temperature information and the humidity information. For example, under a high-temperature and high-humidity condition, a large conveying force is required due to moisture contained in the sheet 9. Therefore, the position determination unit 74 corrects the height position of the paddle member 50 to be low when the temperature information is equal to or higher than the predetermined temperature and the humidity information is equal to or higher than the predetermined humidity. The controller 8 may acquire the temperature information and the humidity information from a temperature sensor and a humidity sensor (not illustrated) mounted on the image forming apparatus 1.

The drive controller 75 drives motors 57 and 64 to operate the paddle member 50, thereby aligning the rear ends of the plurality of sheets 9 on the tray 35. The drive controller 75 drives the motor 57 so that the sheet 9 is located at the height position determined by the position determination unit 74 every time one sheet 9 is conveyed. For example, the drive controller 75 determines the number of pulses for driving the motor 57, based on the height position determined by the position determination unit 74. Next, the drive controller 75 provides the motor 57 with a drive signal having the determined number of pulses, thereby rotating the rotary disk 58 by a predetermined angle. Thus, the paddle member 50 descends to the height position determined by the position determination unit 74. The drive controller 75 also drives the motor 64 at a predetermined timing to rotate the paddle member 50. Thus, an optimum conveying force is applied to the topmost sheet 9 placed on the tray 35. Furthermore, after aligning the sheet 9, the drive controller 75 stops the motor 64 and drives the motor 57 to return the paddle member 50 to the retracted position. The drive controller 75 repeats such an operation every time a sheet 9 is discharged from the image forming apparatus 1.

The drive controller 75 aligns the sheet 9 discharged from the image forming apparatus 1 on the tray 35 by rotating the paddle member 50, for example, twice. At this time, when the predetermined condition is satisfied, the drive controller 75 may perform control to raise the paddle member 50 at a predetermined timing before the two-rotation operation of the paddle member 50 is completed. Here, the predetermined condition is, for example, a condition in which the sheet 9 discharged from the image forming apparatus 1 is easily buckled. For example, when the sheet 9 is of a specific paper type, the predetermined condition is satisfied. The predetermined condition is also established when the temperature and the humidity are in predetermined states. Furthermore, the predetermined condition is satisfied also in a case where the setting of the print job includes a predetermined setting. When such a condition is satisfied, the controller 8 raises the paddle member 50 at a predetermined timing before the completion of the two-rotation operation of the paddle member 50, thereby weakening the conveying force of the sheet 9 and preventing buckling of the sheet 9. When the controller 8 raises the paddle member 50 before the completion of the two-rotation operation of the paddle member 50, the controller 8 may raise the paddle member 50 stepwise. Provided that instead of raising the paddle member 50 in a stepwise manner, the controller 8 may raise the paddle member 50 in a stepless manner.

Figure 16:
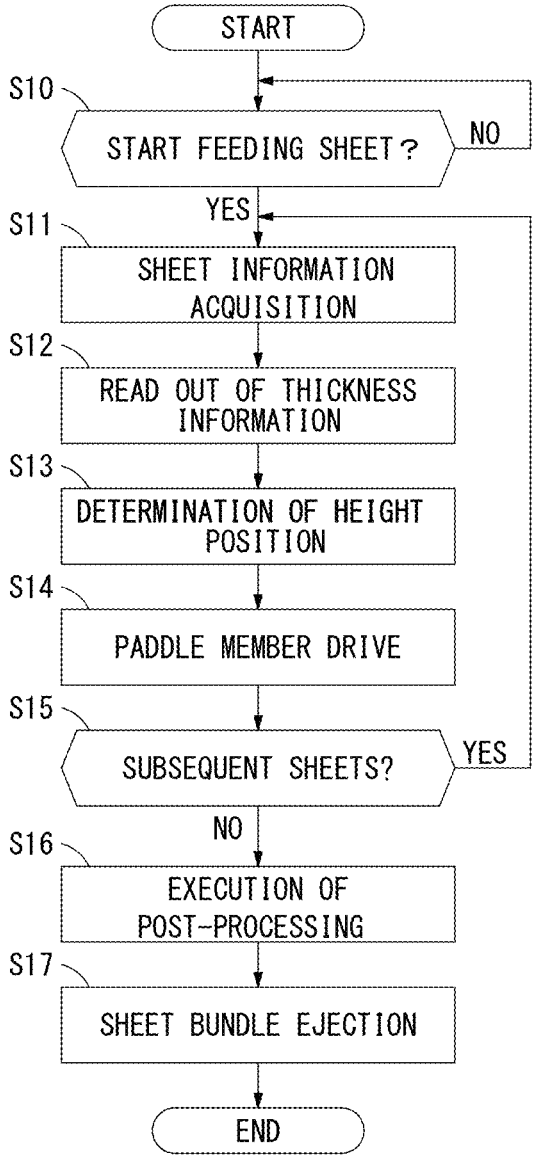
FIG. 16 is a flowchart illustrating an example of a processing procedure by a controller.

FIG. 16 is a flowchart illustrating an example of a processing procedure by the controller 8. The controller 8 waits until a sheet feed operation is started by execution of a print job by the image forming apparatus 1 (step S10). When the sheet feeding operation is started in the image forming apparatus 1 (YES in step S10), the controller 8 acquires the sheet information of the sheet 9 being conveyed from the image forming apparatus 1 (step S11). The controller 8 reads out the thickness-related information of the sheet 9 from the sheet information acquired from the image forming apparatus 1 (step S12). Next, the controller 8 determines the height position at which the paddle member 50 is to be raised or lowered (step S13).

Figure 17:
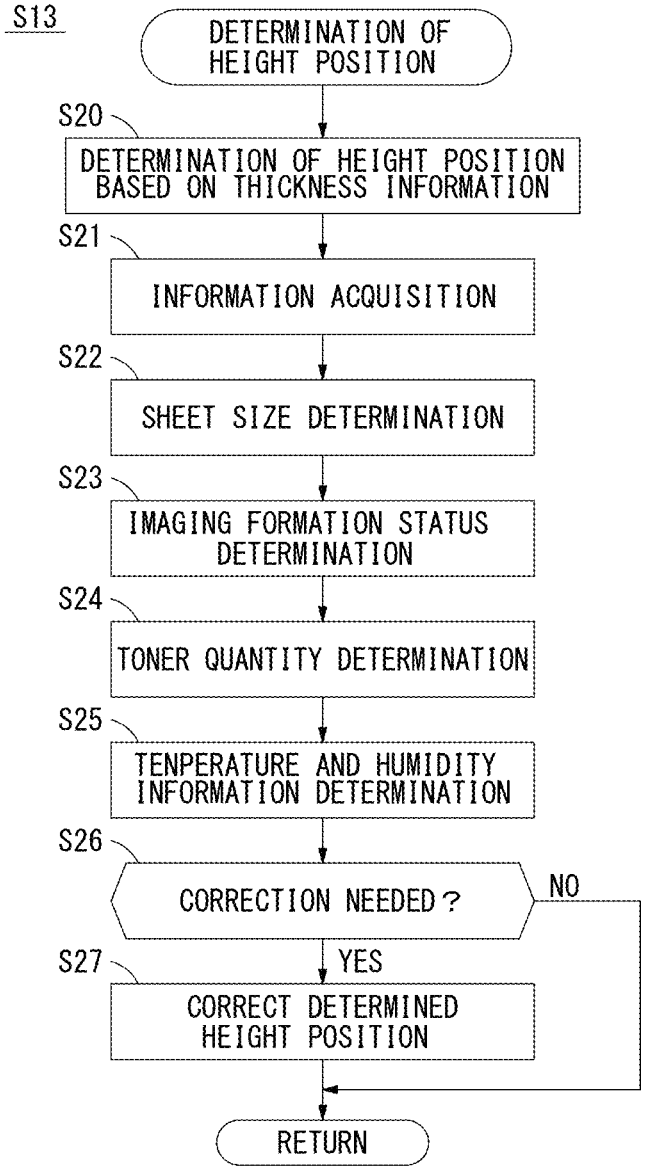
FIG. 17 is a flowchart illustrating an example of a detailed processing procedure of a height position determination processing

FIG. 17 is a flowchart illustrating an example of a detailed processing procedure of height position determination processing (step S13). The controller 8 determines the height position of the puddle member 50 based on the height information read from the sheet information (step S20). At this time, the controller 8 may determine the height position of the paddle member 50 by performing the calculation based on the formula (1) or (2) based on the number of sheets 9 stacked on the tray 35 and the thickness information of the sheets 9. Further, the controller 8 may determine the height position of the paddle member 50 by referring to a lookup table.

Next, the controller 8 acquires information to be referred to when correcting the height position determined in step S20 (step S21). For example, the controller 8 acquires size information on the sheet 9, information on an image formation state, information on a toner amount, temperature information, humidity information, and the like. Upon acquiring the information for correction, the controller 8 first determines the size of the sheet 9 based on the size information (step S22). Next, the controller 8 determines the states of image formation on both the front and back sides of the sheet 9 (step S23). Next, the controller 8 determines the amount of toner transferred to the sheet 9 (step S24). Further, the controller 8 determines temperature information and humidity information (step S25). Next, the controller 8 determines, based on results of the determinations in the above steps S22 to S25, whether the height position of the paddle member 50 needs to be corrected (step S26).

If correction is necessary (YES in step S26), the controller 8 corrects the height position of the paddle member 50 based on the determination results of steps S22 to S25 (step S27). Thus, a height position at which the paddle member 50 is driven is changed. On the other hand, when the correction is not necessary (NO in step S26), the process of step S27 is not performed. In this case, the height position determined in step S20 is adopted as the height position when the paddle member 50 is driven.

Return to the flowchart of FIG. 16. After determining the height position of the paddle member 50, the controller 8 drives the paddle member 50 (step S14). At this time, the controller 8 controls the height position of the paddle member 50 based on the height position determined in step S13.

Figure 18:
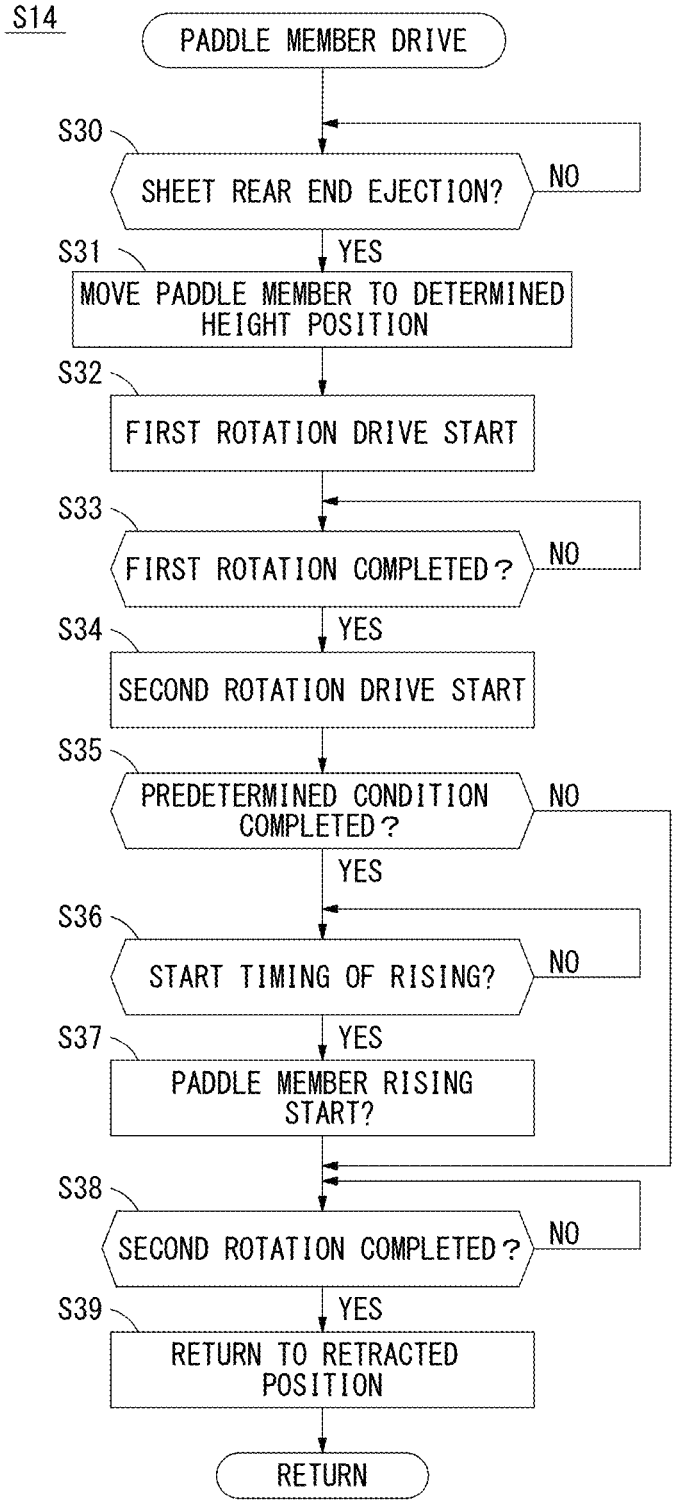
FIG. 18 is a flowchart illustrating an example of a detailed processing procedure of the paddle member driving processing.

FIG. 18 is a flowchart illustrating an example of a detailed processing procedure of the paddle-member driving processing (step S14). The controller 8 waits until the rear end of the sheet 9 is discharged from the image forming apparatus 1 (step S30). At this time, the paddle member 50 is in a state of being raised to the retracted position. When the rear end of the sheet 9 is discharged from the image forming apparatus 1 (YES in step S30), the controller 8 moves the puddle member 50 to the height position determined in step S13 (step S31). That is, the controller 8 starts driving of the motor 57. As a result, the paddle member 50 is lowered from the retracted position, and the sheet 9 discharged onto the tray 35 is knocked down onto the upper surface of the tray 35.

When starting the lowering of the paddle member 50, the controller 8 starts the rotation operation of the first rotation of the paddle member 50 at a predetermined timing (step S32). That is, the controller 8 drives the motor 64 and starts an operation of rotating the paddle member 50 once. Thereafter, the controller 8 waits until the first rotation of the puddle member 50 is completed (step S33). When the first rotation of the paddle member 50 ends (YES in step S33), the controller 8 starts the rotation operation of the second rotation of the paddle member 50 (step S34).

Upon starting the operation for the second rotation, the controller 8 determines whether a predetermined condition is established (step S35). That is, the controller 8 determines whether or not a condition under which the sheet 9 tends to buckle is satisfied as the predetermined condition. If the predetermined condition is established (YES in step S35), the controller 8 waits until it is time to start raising the paddle member 50 (step S36). At the timing of starting to raise the paddle member 50 (YES in step S36), the controller 8 drives the motor 57 to start the operation of raising the paddle member 50 (step S37). Thereafter, upon ending of the second rotation of the paddle member 50 (YES in step S38), the controller 8 returns the paddle member 50 to the retracted position (step S39).

On the other hand, when the predetermined condition is not satisfied (NO in step S35), the controller 8 holds the paddle member 50 at the determined height position without raising the paddle member 50. That is, the controller 8 waits until the second rotation of the paddle member 50 ends (step S38). When the second rotation of the paddle member 50 is completed (YES in step S38), the controller 8 drives the motor 57 to return the paddle member 50 to the retracted position (step S39).

The process returns to the flowchart of FIG. 16 again. When the driving of the paddle member 50 as described above ends, the controller 8 determines whether or not there is a subsequent sheet (step S15). If there is a subsequent sheet 9 (YES in step S15), the process by the controller 8 returns to step S11, and the above-described process is repeated. As a result, the plurality of sheets 9 are stacked on the tray 35, and the rear ends of the plurality of sheets 9 are aligned.

When there is no subsequent sheet 9 (NO in step S15), the controller 8 drives the post-processing unit 39 to perform post-processing on the plurality of sheets 9 stacked on the tray 35 (step S16). Thereafter, the controller 8 drives ejection means (not illustrated) to eject the bundle of sheets on the tray 35 to the sheet discharge tray 41 (step S17). Thus, the processing by the controller 8 ends.

Figure 19A:
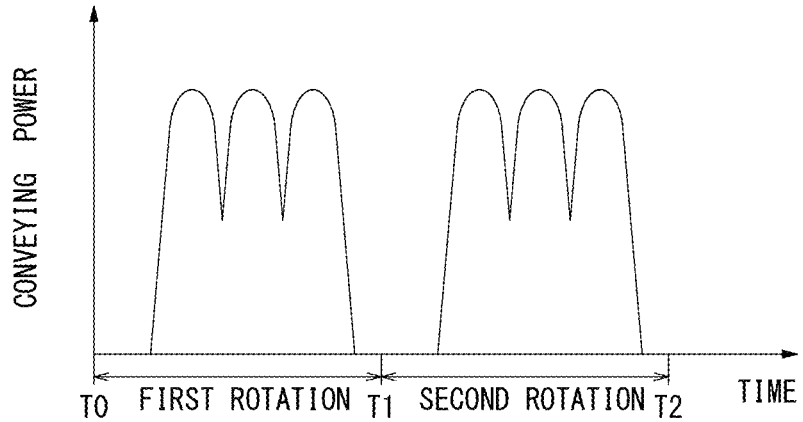
Figure 19B:
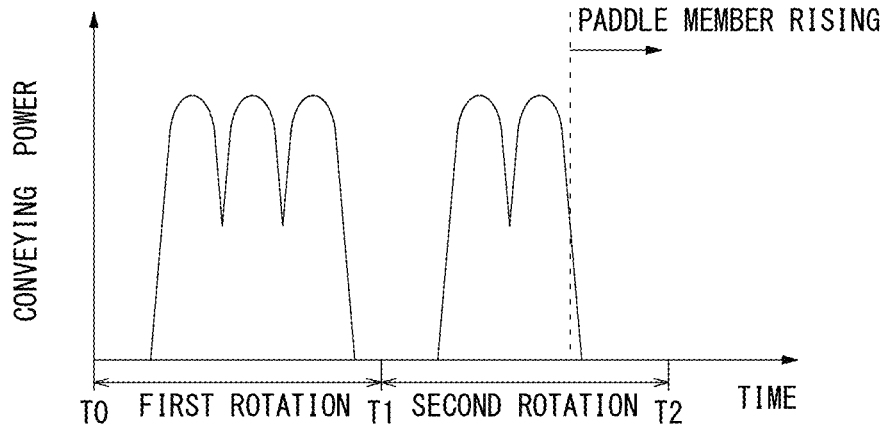
Figure 19B:
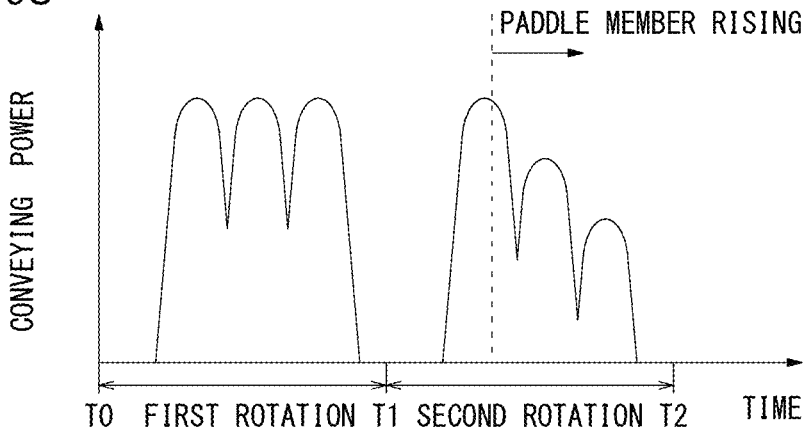

FIG. 19A, FIG. 19B, and FIG. 19C are views showing the conveying force applied to the sheet 9 by the two rotations of the paddle member 50. FIG. 19A shows the conveying force applied to the sheet 9 when the paddle member 50 do not rise during the second rotation. As shown in FIG. 19A, the three fins 52 sequentially abut against the sheet 9 during one rotation of the paddle member 50 to apply a conveying force to the sheet 9. Therefore, while the paddle member 50 makes one rotation, the conveying force appears as three mountain-shaped waveforms. When the paddle member 50 does not rise in the middle of the second rotation, the conveying force in the second rotation appears as three mountain-shaped waveforms as in the first rotation. The sheet 9 receives the conveying force appearing as the six mountain-shaped waveforms and is conveyed toward the restricting member 37.

On the other hand, when the predetermined condition is satisfied, the paddle member 50 starts to rise in the middle of the second rotation. The conveying force in this case appears as illustrated in FIG. 19B or FIG. 19C. For example, when the controller 8 raises the paddle member 50 at high speed from the middle of the second rotation, the number of mountain-shaped waveforms that appear as the conveying force can be reduced as illustrated in the FIG. 19B of the drawing. In the example of FIG. 19B, the third mountain-shaped waveform disappears in the second rotation of the paddle member 50. In this case, the conveying force applied to the sheet 9 can be reduced. In particular, the conveying force to be applied after the trailing end of the sheet 9 abuts against the restricting member 37 can be eliminated. Therefore, buckling of the sheet 9 can be prevented.

Further, when the controller 8 raises the puddle member 50 at a low speed in the middle of the second rotation, the magnitude of the mountain-shaped waveform appearing as the conveying force can be gradually reduced as shown in FIG. 19C of the drawing. In the example of FIG. 19C in the drawing, in the second rotation of the paddle member 50, the second mountain-shaped waveform is smaller than the first mountain-shaped waveform, and the third mountain-shaped waveform is smaller than the second mountain-shaped waveform. Also in this case, the conveying force to be applied to the sheet 9 can be reduced. In particular, the conveying force to be applied after the trailing end of the sheet 9 abuts against the restricting member 37 can be reduced. Therefore, buckling of the sheet 9 can be prevented.

As described above, the sheet processing apparatus 5 of the present embodiment is mounted in the body space 6 of the apparatus body 1*a* of the image forming apparatus 1. Since the body space 6 of the image forming apparatus 1 is a narrow space between the printer unit 4 and the scanner unit 2, the height of the sheet processing apparatus 5 is limited. Therefore, the paddle member 50 mounted on the sheet processing apparatus 5 is reduced in diameter. The sheet processing apparatus 5 of the present embodiment can apply an appropriate conveying force to the sheet 9 even when the paddle member 50 having a reduced diameter is used. That is, the sheet processing apparatus 5 is configured to determine the height position of the paddle member 50 on the tray 35 based on the number of sheets stacked on the tray 35 and sheet information of the sheet 9 to be conveyed, and to control the height position of the paddle member 50. With this structure, even the paddle member 50 having a reduced diameter can apply an appropriate conveying force to the sheet 9.

A preferred embodiment of the present invention has been described above. However, the present invention is not limited to the content described in the above embodiment, and various modification examples are applicable.

For example, the above embodiment is described with the example in which the sheet processing apparatus 5 is installed in the body space 6 of the image forming apparatus 1. However, the sheet processing apparatus 5 having the above-described configuration is not necessarily limited to one installed in the body space 6 of the image forming apparatus 1. For example, the sheet processing apparatus 5 may be installed adjacent to the image forming apparatus 1 side by side.

Furthermore, the above-described embodiment is described with the example in which the controller 8 provided in the sheet processing apparatus 5 controls the operation of the paddle member 50. However, the present invention is not limited thereto, and for example, the controller 8 of the sheet processing apparatus 5 may be integrated into the controller 7 of the image forming apparatus 1.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet processing apparatus comprising:

a tray on which conveyed sheets are stacked one by one;

a restricting member provided at one end of the tray;

a paddle member provided so as to be able to ascend and descend on the tray and configured to abut and align one end of the sheet against the restricting member by rotating in contact with the conveyed sheet;

a controller that determines a height position of the paddle member on the tray based on the number of sheets stacked on the tray and sheet information of the sheet to be conveyed, and controls the height position of the paddle member;

a holding member that holds the paddle member at a tip end portion thereof and changes the height position of the paddle member by swinging around a rotating shaft inserted through a base end portion thereof; and a swing arm that engages with the tip end portion of the holding member to swing the holding member, wherein the controller controls the height position of the paddle member by driving the swing arm to swing the holding member.

2. The sheet processing apparatus according to claim 1, wherein the controller changes the height position of the paddle member every time the sheet is conveyed one by one.

3. The sheet processing apparatus according to claim 1, wherein the sheet information includes thickness information of the sheet, and the controller determines the height position of the paddle member based on the number of sheets and the thickness information.

4. The sheet processing apparatus according to claim 3, wherein the controller determines a basis weight classification of the sheet based on the thickness information, and determines the height position of the paddle member based on a representative value predetermined for the basis weight classification.

5. The sheet processing apparatus according to claim 3, wherein the sheet information includes size information of the sheet, and the controller corrects the determined height position of the paddle member based on the size information.

6. The sheet processing apparatus according to claim 5, wherein

When a sheet size indicated by the size information is larger than a predetermined size, the controller corrects the height position of the paddle member to a position lower than the determined height position.

7. The sheet processing apparatus according to 3, wherein

The controller corrects the determined height position of the paddle member in accordance with an image forming state with respect to the front and back of the sheet to be conveyed.

8. The sheet processing apparatus according to claim 3, wherein

The controller corrects the determined height position of the paddle member based on an amount of toner transferred to the sheet to be conveyed.

9. The sheet processing apparatus according to claim 3, wherein the controller acquires temperature information and humidity information, and corrects the determined height position of the paddle member based on the temperature information and the humidity information.

10. The sheet processing apparatus according to claim 1, wherein the paddle member includes a rotor and a fin having elasticity and projecting outward from an outer peripheral surface of the rotor, and conveys the sheet toward the restricting member by rotating the rotor in a predetermined direction in a state where the fin is brought into contact with the sheet, and brings one end of the sheet into contact with the restricting member.

11. The sheet processing apparatus according to claim 10, wherein the paddle member includes a fin formed portion that causes the fin to abut on the sheet to apply a conveying force to the sheet in accordance with rotation of the rotor in the predetermined direction, and a fin non-formed portion that does not cause the fin to abut on the sheet and does not apply the conveying force to the sheet.

12. The sheet processing apparatus according to claim 11, wherein a plurality of fins is formed at the fin formed portion at predetermined intervals, and when any of the plurality of fins abuts on the sheet and is elastically deformed, the fin does not interfere with another adjacent fin.

13. The sheet processing apparatus according to claim 1, wherein the controller raises the paddle member while the sheet is being conveyed toward the restricting member by rotating the paddle member at the determined height position.

14. An image forming system comprising:

an image forming apparatus that conveys a sheet one by one and forms an image on the sheet being conveyed; and a sheet processing apparatus including:

a tray on which conveyed sheets are stacked one by one;

a restricting member provided at one end of the tray;

a paddle member provided so as to be able to ascend and descend on the tray and configured to abut and align one end of the sheet against the restricting member by rotating in contact with the conveyed sheet;

a controller that determines a height position of the paddle member on the tray based on the number of sheets stacked on the tray and sheet information of the sheet to be conveyed, and controls the height position of the paddle member; and a holding member that holds the paddle member at a tip end portion thereof and changes the height position of the paddle member by swinging around a rotating shaft inserted through a base end portion thereof; and a swing arm that engages with the tip end portion of the holding member to swing the holding member, wherein the controller controls the height position of the paddle member by driving the swing arm to swing the holding member, and wherein the sheet processing apparatus receives the sheet on which an image is formed in the image forming apparatus, and aligns one end of the sheet on the tray by making the one end abut on the restricting member.

15. The image forming system according to claim 14, wherein the sheet processing apparatus is mounted on a body space of an apparatus main body of the image forming apparatus.

16. A control method for controlling a sheet processing apparatus comprising:

a tray on which sheets to be conveyed are stacked one by one;

a restricting member provided at one end of the tray; and a paddle member that is provided so as to be able to ascend and descend on the tray and that abuts one end of the sheet against the restricting member to align the sheet by rotating in contact with the sheet to be conveyed, the method including:

determining the height position of the paddle member on the tray based on the number of sheets stacked on the tray and sheet information of the sheet to be conveyed, and controlling the height position of the paddle member; and holding, by a holding member, the paddle member at a tip end portion thereof and changing, by the holding member, the height position of the paddle member by swinging around a rotating shaft inserted through a base end portion thereof; and engaging, by a swing arm, with the tip end portion of the holding member to swing the holding member, wherein the controller controls the height position of the paddle member by driving the swing arm to swing the holding member.

* * * * *